US006247970B1

(12) United States Patent
Ueno et al.

(10) Patent No.: US 6,247,970 B1
(45) Date of Patent: Jun. 19, 2001

(54) PLUG CONNECTOR, JACK CONNECTOR AND CONNECTOR ASSEMBLY

(75) Inventors: Moriyuki Ueno; Hirofumi Yanagisawa; Yasuyuki Miki; Akira Okada; Satoshi Katoh; Junichi Akama, all of Tokyo (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/186,701

(22) Filed: Nov. 6, 1998

(30) Foreign Application Priority Data

Aug. 24, 1998 (JP) ..... 10-237473

(51) Int. Cl.[7] ..... H01R 13/648
(52) U.S. Cl. ..... 439/608; 439/108; 439/610
(58) Field of Search ..... 439/608, 609, 439/610, 108

(56) References Cited

U.S. PATENT DOCUMENTS

| | | | | |
|---|---|---|---|---|
| 4,762,500 | | 8/1988 | Dola et al. . | |
| 4,824,383 | * | 4/1989 | Lemke | 439/108 |
| 4,836,791 | * | 6/1989 | Grabbe et al. | 439/79 |
| 5,195,899 | | 3/1993 | Yatsu et al. . | |
| 5,238,414 | | 8/1993 | Yaegashi et al. . | |
| 5,645,436 | | 7/1997 | Shimizu et al. . | |
| 5,660,551 | * | 8/1997 | Sakurai | 439/108 |
| 5,813,871 | | 9/1998 | Grabbe et al. . | |

FOREIGN PATENT DOCUMENTS

| | | |
|---|---|---|
| 0 365 179 | 4/1990 | (EP) . |
| 0 486 298 | 5/1992 | (EP) . |
| 0 563 942 | 10/1993 | (EP) . |
| 0 567 007 | 10/1993 | (EP) . |

OTHER PUBLICATIONS

U.S. application No. 09/086525, Junichi et al., filed May 29, 1998.

Akama, Junichi et al., "High Density Connector for Differential Data Transfer", 30th Annual Connector and Interconnection Symposium and Trade SHow, Anaheim, California, Sep. 22–24, 1997, pp. 277–282.

Akama, Junichi et al., "High Density Connector for Differential Data Transfer", Technical Report of IEICE (Oct. 1997), pp. 25–29.

Akama, Junichi et al., "High Density Connector for Differential Data Transfer", 30th Annual Connector and Interconnection Symposium and Trade Show, Anaheim, California, Sep. 22–24, 1997, pp. 277–282.

Akama, Junichi et al., "High Density Connector for Differential Data Transfer", Technical Report of IEICE (Oct. 1997), pp. 25–29.

* cited by examiner

*Primary Examiner*—Paula Bradley
*Assistant Examiner*—Truc Nguyen
(74) *Attorney, Agent, or Firm*—Staas & Halsey LLP

(57) ABSTRACT

A connector assembly for balanced transmission includes a plug connector wherein a plurality of plug-type contact element arrays extend parallel to each other and a plug-type ground plate is disposed between neighboring plug-type contact element arrays, and a jack connector wherein a plurality of jack-type contact element arrays extend parallel to each other and a jack-type ground contact elements for the plug-type ground plate are disposed between neighboring jack-type contact element arrays.

13 Claims, 17 Drawing Sheets

PLUG CONNECTOR, JACK CONNECTOR AND CONNECTOR ASSEMBLY

BACKGROUND OF THE INVENTION

1. Field of the Invention

The present invention generally relates to a plug connector, a jack connector and a connector assembly, and particularly relates to a connector assembly used for balanced transmission.

2. Description of the Related Art

Conventional connector assemblies for connecting personal computers and peripheral equipment are designed for use with an unbalanced transmission system. This is because the unbalanced transmission system is a major transmission system since it exhibits a good cost efficiency. Also, when a number of signals increases, two separate connector assemblies are used for a transmission. This structure requires a relatively larger mounting area on the printed-circuit board.

Recently, along with rapid improvement in personal computers and computer networks, there is a need for transmitting a large amount of data, particularly moving-image data. In order to transmit a large amount of moving-image data, a high-speed transmission of at least 1 gigabit/sec is required. However, the unbalanced transmission system is not suitable for such a high-speed transmission since it is easily affected by noise. Thus, for a high-speed transmission, a balanced transmission system is preferred since it is less affected by noise as compared to the unbalanced transmission system.

Therefore, there is a need for a plug connector, a jack connector and a connector assembly which can be used in a balanced transmission system.

SUMMARY OF THE INVENTION

Accordingly, it is a general object of the present invention to provide a jack connector, a plug connector and a connector assembly which can satisfy the needs described above.

It is another and more specific object of the present invention to provide a connector assembly which can transmit a comparatively large number of signals and which has a reduced size.

In order to achieve the above object, a connector assembly used for balanced transmission includes a plug connector and a jack connector as described below.

A plug connector for balanced transmission includes:

a plurality of plug-type contact element arrays, each plug-type contact element array having a plurality of pairs of plug-type signal contact elements arranged parallel to each other in a row and a plurality of plug-type ground contact elements arranged alternately with the plurality of pairs of plug-type signal contact elements in the row;

a plug-type ground plate; and a plug-type insulating body made of an electrically insulating material for supporting the plurality of plug-type contact element arrays and the plug-type ground plate, wherein the plurality of plug-type contact element arrays extend parallel to each other and the plug-type ground plate is disposed between neighboring plug-type contact element arrays.

The plug connector described above is provided with an increased number of plug-type signal contact elements. Also, the plug connector has a compact shape with a substantially square-shaped area when viewed vertically downwards.

A jack connector for balance transmission includes:

a plurality of jack-type contact element arrays, each jack-type contact element array having a plurality of pairs of jack-type signal contact elements arranged parallel to each other in a row and a plurality of jack-type ground contact elements arranged alternately with the plurality of pairs of jack-type signal contact elements in the row;

a plurality of jack-type ground contact elements for a plug-type ground plate; and a jack-type insulating body made of an electrically insulating material for supporting the plurality of jack-type contact element arrays and the jack-type ground contact elements for the plug-type ground plate, wherein the plurality of jack-type contact element arrays extend parallel to each other and the jack-type ground contact elements for the plug-type ground plate are disposed between neighboring jack-type contact element arrays.

The jack connector described above is provided with an increased number of jack-type signal contact elements. Also, the jack connector has a compact shape with a substantially square-shaped area when viewed vertically downwards.

It is a still another object of the present invention to provide a connector assembly having a further reduced size.

In order to achieve the above object, the jack-type ground contact elements for the plug-type ground plate are arranged at both ends of the jack-type insulating body so as to be in contact with the plug-type ground plate at both end surfaces of the plug-type ground plate.

The jack-type ground contact elements for the plug-type ground plate can be accommodated within the thickness of the plug-type ground plate.

It is a yet another object of the present invention to provide a connector assembly which does not require a soldering process when mounting a plug connector and a jack connector on a printed-circuit board.

In order to achieve the above object, terminal parts of the signal contact elements and the ground contact elements of the plug connector and/or the jack connector have a press-fit structure.

It is a yet another object of the present invention to provide a connector assembly which does not require a power-supply plug to be connected to a power supply jack.

In order to achieve the above object, the jack connector further includes jack-type power-supply contact elements and the plug connector further includes plug-type power-supply contact elements.

It is a yet another object of the present invention to provide a connector assembly which does not require external shielding plates.

In order to achieve the above object, each of the plug-type ground contact elements has a main plate part separating the neighboring pairs of plug-type signal contact elements and two wing parts each extending from the respective ends of the main plate part, the wing parts covering outside of the plug-type signal contact elements.

It is a yet another object of the present invention to provide a connector assembly which has a reduced length.

In order to achieve the above object, the plug-type contact element array has a structure such that plug-type signal contact elements are provided on both ends of the plug-type contact element array, respectively. Also, a pitch between each one of the plug-type signal contact elements at both ends and an adjacent plug-type ground contact element is less than a pitch between adjacent plug-type signal contact elements provided at positions other than ends of the plug-type contact element array.

It is a yet another object of the present invention to provide a connector assembly which has a stable connection between the plug-type signal contact elements and the jack-type signal contact elements.

In order to achieve the above object, each of the plug-type signal contact elements has a knife-shape and each of the jack-type signal contact elements has a fork-shape. The plug-type signal contact elements are supported between the jack-type signal contact elements.

It is a yet another object of the present invention to provide a connector assembly which is constructed using fewer components and is reduced in its weight and cost.

In order to achieve the above object, a plug connector for balanced transmission includes:

a plug-type insulating body including a plug-type insulating body main part made of an electrically insulating material and a plug-type contact element array component inserted into the plug-type insulating body main part, wherein the plug-type insulating body main part is provided with a shield surrounding part made of conductive resin on an inner surface, and the plug-type contact element array component includes a substantially plate-like array component main part made of electrically insulating resin, a plurality of pairs of plug-type signal contact elements arranged parallel to each other in a row and a plurality of plug-type ground contact elements arranged alternately with the plurality of pairs of plug-type signal contact elements in the row, the plug-type signal contact elements and the plug-type ground contact elements filling a plurality of grooves formed on the plug-type insulating body main part.

It is a yet another object of the present invention to provide a connector assembly which has a reduced size.

In order to achieve the above object, a connector assembly used for balanced transmission includes a plug connector and a jack connector as described below.

A plug connector for balanced transmission includes:

a plug-type insulating body made of an electrically insulating resin provided with a plurality of grooves on the front surface so as to divide the front surface into a plurality of peripheral islands and one central island;

a plurality of pairs of plug-type signal contact elements provided in a fylfot arrangement on the peripheral four islands;

a plug-type central signal contact element provided on the central island; and a plurality of plug-type ground contact elements provided on the plurality of grooves, respectively.

A jack connector for balanced transmission includes:

a jack-type insulating body made of an electrically insulating resin provided with a plurality of jack-type ground contact elements;

a plurality of sets of two pairs of jack-type signal contact elements provided in a fylfot arrangement on the jack-type insulating body;

a jack-type central signal contact element provided at the center of the jack-type insulating body; and a surrounding shield plate provided on an inner surface of the jack-type insulating body.

The connector assembly described above has a compact structure having a substantially square front view.

In order to achieve the above object, a plug connector for balanced transmission includes:

at least one cylindrical shielding member;

a plurality of plug-type ground contact elements arranged inside the shielding member in a radial direction at equal angular intervals; and a plurality of plug-type signal contact elements provided in a chamber part between neighboring plug-type ground contact elements.

The plug connector described above has a compact structure having a substantially circular front view.

Other objects and further features of the present invention will be apparent from the following detailed description when read in conjunction with the accompanying drawings.

DETAILED DESCRIPTION OF THE PREFERRED EMBODIMENTS

In the following, principles and embodiments of the present invention will be described with reference to the accompanying drawings.

Figure 1:
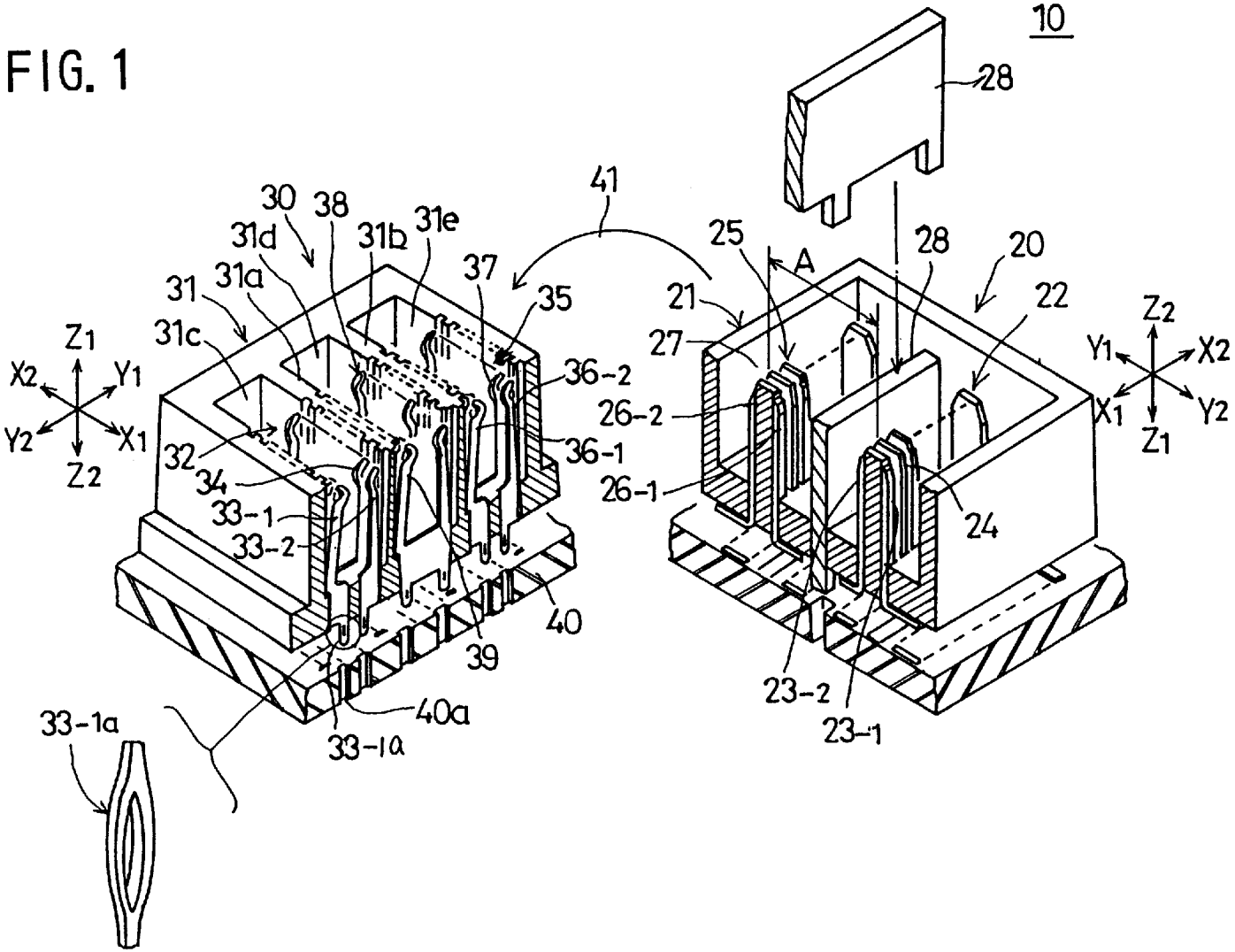
FIG. 1 is a perspective diagram showing a connector assembly of a first embodiment of the present invention.

FIG. 1 is a perspective diagram showing a connector assembly 10 for balanced transmission in accordance with a first embodiment of the present invention.

The connector assembly 10 has a structure suitable for a balanced transmission and for a considerably greater number of signals. The connector assembly 10 includes a plug connector 20 for balanced transmission and a jack connector 30 for balanced transmission. Throughout the figures, X1 and X2 directions show longitudinal directions, Y1 and Y2 directions show lateral directions and Z1 and Z2 directions show vertical directions of the connector assembly.

The plug connector 20 includes a plug-type electrically insulating body 21 (hereinafter referred to as a plug insulator 21), first and second plug-type contact element arrays 22, 25 (hereinafter referred to as plug contact arrays 22, 25) and a plug-type ground plate 28. The plug contact arrays 22, 25 extend parallel to each other in X1–X2 directions. The plug-type ground plate 28 is disposed between the plug contact arrays 22, 25.

The first plug contact array 22 includes a plurality of pairs of plug-type signal contact elements 23-1, 23-2 and a plurality of plug-type ground contact elements 24 alternately arranged in the X1–X2 directions. Each of the plug-type ground contact elements 24 (hereinafter referred to as plug ground contacts 24) has a plate-like shape. Also, the signal contact elements 23-1, 23-2 are hereinafter referred to as plug signal contacts 23-1, 23-2.

The second plug contact array 25 has a structure similar to that of the first plug contact array 22. The second plug contact array 25 includes a plurality of pairs of plug-type signal contact elements 26-1, 26-2 and a plurality of plug-type ground contact elements 27 alternately arranged in the X1–X2 directions. Each of the plug-type ground contact elements 27 (hereinafter referred to as plug ground contacts 27) has a plate-like shape. Also, the plug-type signal contact elements 26-1, 26-2 are hereinafter referred to as plug signal contacts 26-1, 26-2.

The plug-type ground plate 28 has a plate-like shape and serves as a partition between the first and second plug contact arrays 22 and 25.

The distance A between the first and second plug contact arrays 22 and 25 is smaller than that of a structure where separate plug connectors having a first plug contact array 22 and a second plug contact array 25, respectively, are provided side by side. Therefore, the above-described plug connector 20 has a substantially square-shaped compact structure when viewed in a vertically downward direction.

The jack connector 30 for balanced transmission has a structure corresponding to the above-described plug connector 20 for balanced transmission. The jack connector 30 includes a jack-type electrically insulating body 31 (hereinafter referred to as a jack insulator 31). The jack insulator 31 holds first and second jack-type contact element arrays 32, 35 (hereinafter referred to as jack contact arrays 32, 35) and a jack-type ground contact array 38 for the plug-type ground plate (hereinafter referred to as a jack ground contact array 38). The jack contact arrays 32, 35 and the jack ground contact array 38 extend parallel to each other in X1–X2 directions.

The jack insulator 31 includes partition walls 31*a*, 31*b* and three rectangular recessed parts 31*c*, 31*d*, 31*e* extending in the X1–X2 directions and disposed parallel to each other in the Y1–Y2 direction.

The first jack contact array 32 includes, in the recessed part 31*c*, a plurality of pairs of jack-type signal contact elements 33-1, 33-2 and a plurality of jack-type ground contact elements 34 alternately arranged in the X1–X2 directions. The jack-type ground contact elements 34 will be hereinafter referred to as jack ground contacts 34 and the jack-type signal contact elements 33-1, 33-2 will be hereinafter referred to as jack signal contacts 33-1, 33-2.

The second jack contact array 35 is similar to the first jack contact array 32. The second jack contact array 35 includes, in the recessed part 31*e*, a plurality of pairs of jack-type signal contact elements 36-1, 36-2 and a plurality of jack-type ground contact elements 37 alternately arranged in the X1–X2 directions. The jack-type ground contact elements 37 will be hereinafter referred to as jack ground contacts 37 and the jack-type signal contact elements 36-1, 36-2 will be hereinafter referred to as jack signal contacts 36-1, 36-2.

The jack ground contact array 38 includes, in the recessed part 31*d*, a plurality of jack-type ground contact elements 39 for the plug-type ground plate. The jack-type ground contact elements 39 for the plug-type ground plate are arranged parallel to each other in the X1–X2 directions.

The above-described plug connector has a substantially square-shaped compact structure when viewed in a vertically downward direction.

Also, as shown in an enlarged view in FIG. 1, a terminal 33-1*a* of the jack signal contact 33-1 has a press-fit pin structure. Terminals of other contact elements 33-2, 34-2, 36-1, 36-2, 37 and 38 also have press-fit pin structures. Therefore, the terminals having press-fit pin structures can be pressed into through holes 40*a* of a printed-circuit board 40, so that the jack connector 30 is mounted on the printed-circuit board 40 without soldering.

The above-described structure where terminals have press-fit pin structures can be applied to other embodiments of the jack connector and also to the plug connector.

Figure 2B:
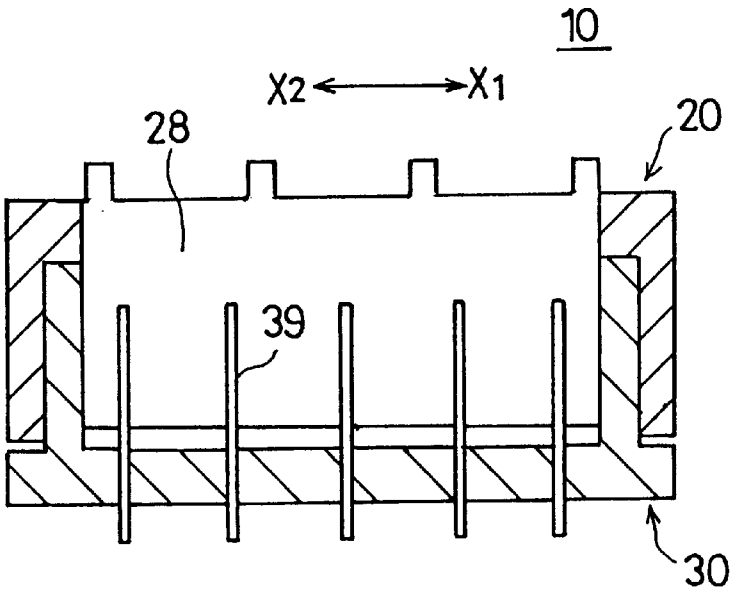
FIG. 2B is a cross-sectional diagram of the connector assembly taken along a line B—B shown in FIG. 2A.
Figure 2A:
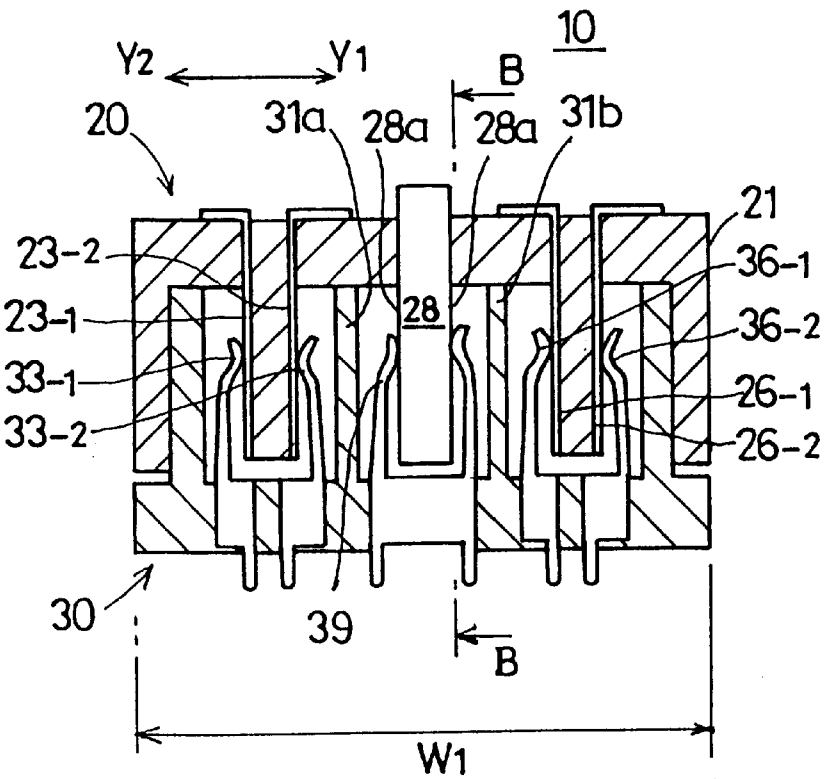
FIG. 2A is a cross-sectional diagram showing the connector assembly shown in FIG. 1.

The plug connector 20 is mated with the jack connector 30 as shown by an arrow 41. FIG. 2A is a cross-sectional diagram showing the connector assembly shown in FIG. 1 and FIG. 2B is a cross-sectional diagram of the connector assembly taken along a line B—B shown in FIG. 2A.

When the plug connector 20 is mated with the jack connector 30, the first and second plug contact arrays 22, 25 and the first and second jack contact arrays 32, 35 are in contact, respectively, and the plug-type ground plate 28 is in contact with the jack-type ground contact array 38. Between the first plug contact array 22 and the first jack contact array 32, the plug signal contacts 23-1, 23-2 and the jack signal contacts 33-1, 33-2 are in contact, respectively, and the plug ground contact 24 is in contact with the jack ground contact 34. Similarly, between the first plug contact array 25 and the first jack contact array 35, the plug signal contacts 26-1, 26-2 and the jack signal contacts 36-1, 36-2 are in contact, respectively, and the plug ground contact 27 is in contact with the jack ground contact 37. Further, the plug-type ground plate 28 is inserted between the jack-type ground contact element 39 such that both longitudinal surfaces 28*a* of the plug-type ground plate 28 are in contact with the jack-type ground contact element 39.

Figure 3:
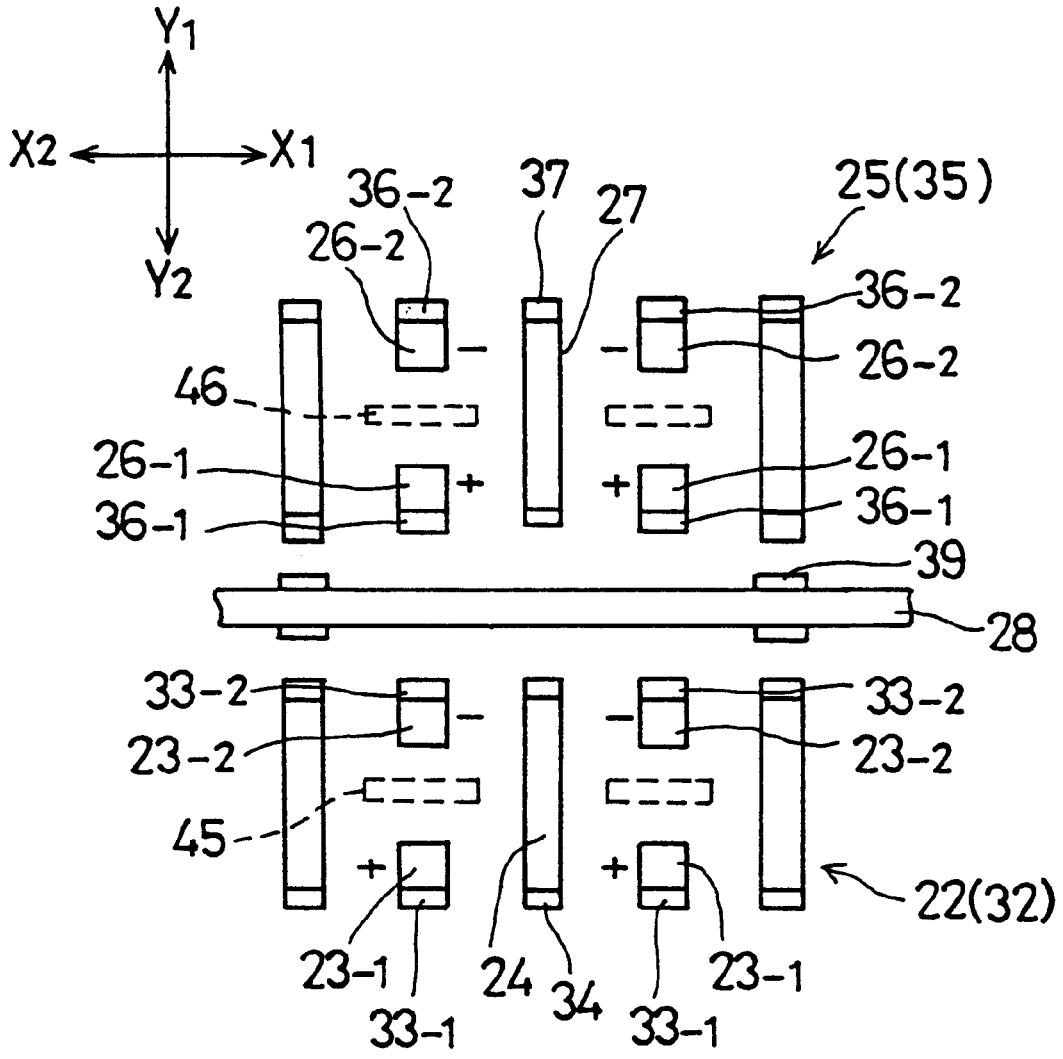
FIG. 3 is a schematic diagram showing a basic structure of the connector assembly shown in FIG. 1.

In the following, also referring to FIG. 3, four characteristics of the connector assembly 10 will be described.

First, the connector 10 has a structure suitable for a considerably greater number of signals and having a smaller mounting area. The plug connector 20 is provided with the single plug insulator 21 and the first and second plug connector arrays 22, 25 supported parallel to each other in the plug insulator 21. Also, the jack connector 30 is provided with the single jack insulator 31 and the first and second plug connector arrays 32, 35 supported parallel to each other in the jack insulator 31. Therefore, it is possible to reduce the mounting area of the connector assembly as compared to a connector having two separate plug connectors, each having a plug connector array, and two separate jack connectors, each having a jack connector array, mounted side by side.

In case where the connector assembly is provided with a plug connector having a single plug insulator supporting a double-length plug contact array and a single jack connector having a single jack insulator supporting a double-length jack contact array, the connector assembly will have a somewhat elongated shape. However, with the plug connector 20 and the jack connector 30, it is possible to mount the connector assembly 10 in a substantially square shaped area. Therefore, it is possible to efficiently mount the connector assembly on the printed-circuit board 40 having a limited size.

Secondly, the connector assembly 10 has a strip-line structure. As shown in FIG. 3, two signal contact elements adjacent to each other in the X1–X2 directions, for example, two plug signal contacts 23-1, are separated by the ground contact 24. Therefore, crosstalk between signals transmitted through one signal contact 23-1 and signals transmitted through another signal contact 23-1 is effectively reduced. This is also true for other signal contact elements 23-2, 26-1 and 26-2.

Thirdly, the connector assembly 10 has a structure such that the contact arrays are shielded between each other. As shown in FIG. 3, the first plug contact array 22 and the first jack contact array 32 are shielded from the second plug contact array 25 and the second jack contact array 35 by the plug-type ground plate 28. The distance between the first plug contact array 22 and the second plug contact array 25 is comparatively small and the distance between the first jack contact array 32 and the second jack contact array 35 is also comparatively small. However, since the plug-type ground plate 28 is provided, crosstalk between signals transmitted through the first plug contact array 22 and the first jack contact array 32 and between signals transmitted through the second plug contact array 25 and the second jack contact array 35 is effectively reduced.

Fourthly, virtual ground planes 45, 46 are created. In FIG. 3, positive signals (+) are transmitted through the plug signal contacts 23-1 and the jack signal contacts 33-1, and negative signals (−), which are equal to and opposite of the positive signals (+), are transmitted through the plug signal contacts 23-2 and the jack signal contacts 33-2. Then, virtual ground planes 45 shown in broken lines are created at regions between the plug signal contacts 23-1 and 23-2. The virtual ground plane 45 is created by an interaction between an electric field created by the plug signal contacts 23-1 and the jack signal contacts 33-1 and an electric field created by the plug signal contacts 23-2 and the jack signal contacts 33-2.

Also, the virtual ground planes 46 are created between the plug signal contacts 26-1 and the plug signal contacts 26-2 in a similar manner.

Since the virtual ground planes 45 are created, crosstalk between signals transmitted through the plug signal contacts 23-1 and the jack signal contacts 33-1 and signals transmitted through the plug signal contacts 23-2 and the jack signal contacts 33-2 is effectively reduced. Similarly, since the virtual ground planes 46 are created, crosstalk between signals transmitted through the plug signal contacts 26-1 and the jack signal contacts 36-1 and signals transmitted through the plug signal contacts 26-2 and the jack signal contacts 36-2 is effectively reduced.

Figure 4:
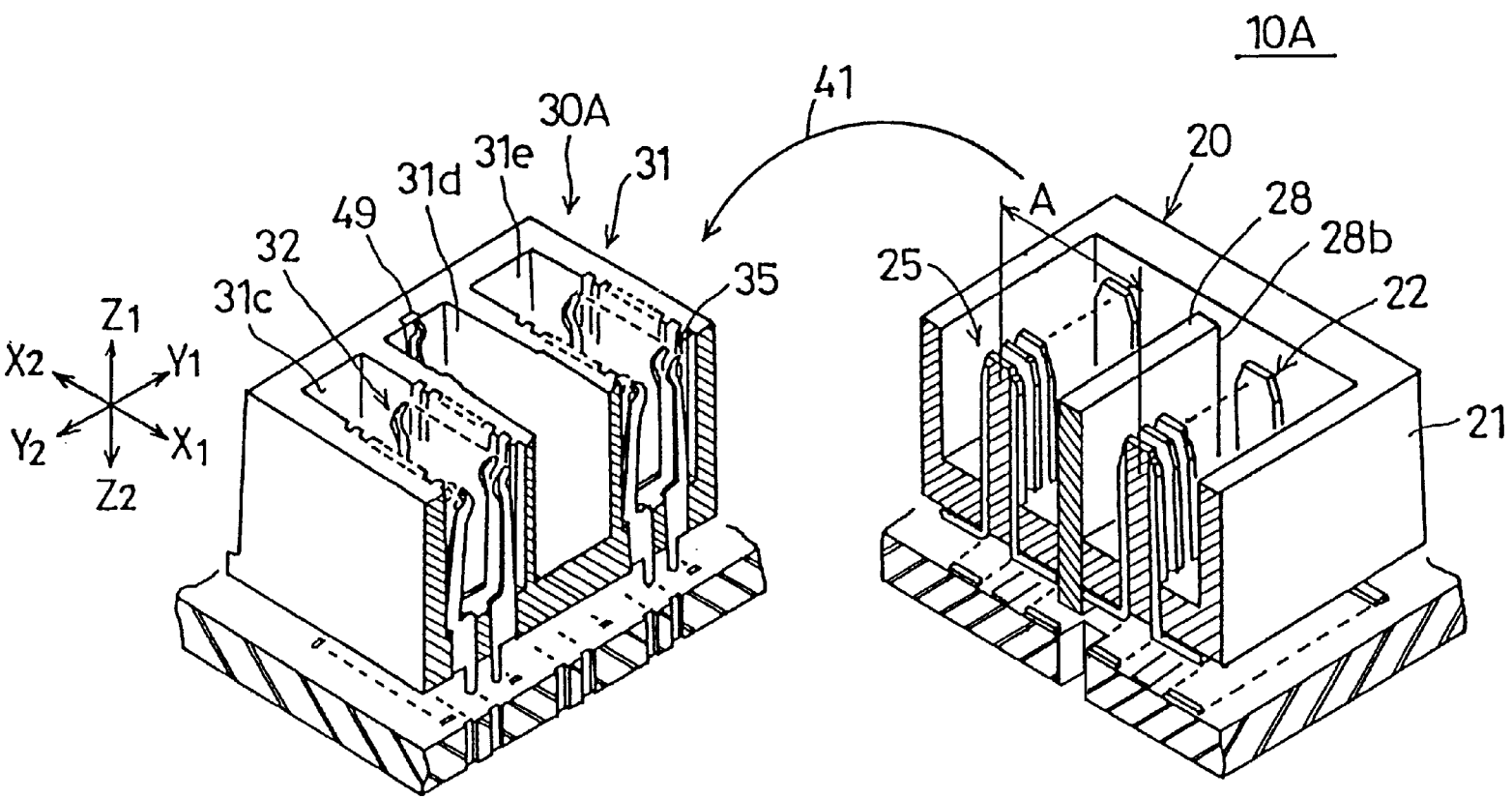
FIG. 4 is a perspective diagram showing a connector assembly of a second embodiment of the present invention.

FIG. 4 is a perspective diagram showing a connector assembly 10A of a second embodiment of the present invention. The connector assembly 10A has a structure similar to that of the connector assembly 10 shown in FIG. 1, and the corresponding elements are shown by the same reference numerals.

The connector assembly 10A includes a plug connector 20, identical to the plug connector shown in FIG. 1, for balanced transmission and a jack connector 30A for balanced transmission.

The jack connector 30A is provided with jack-type ground contact elements 48, 49 (FIG. 5B) for the plug-type ground plate (reference numeral 48 not shown in FIG. 4) instead of the jack-type ground contact element array 38 of the jack connector 30. The jack-type ground contact element 48 is provided inside the recessed part 31*e* at the X1 end and the jack-type ground contact element 49 is provided inside the recessed part 31*e* at the X2 end.

Figure 5B:
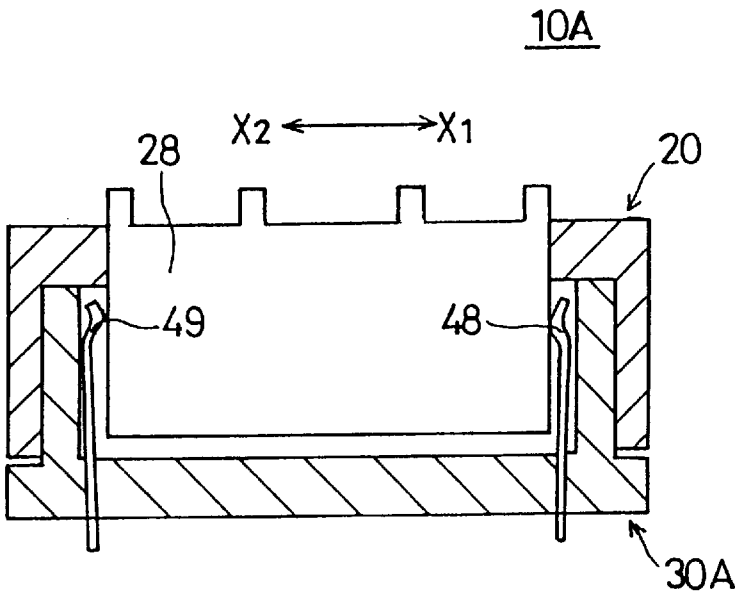
FIG. 5B is a cross-sectional diagram of the connector assembly taken along a line B—B shown in FIG. 5A.
Figure 5A:
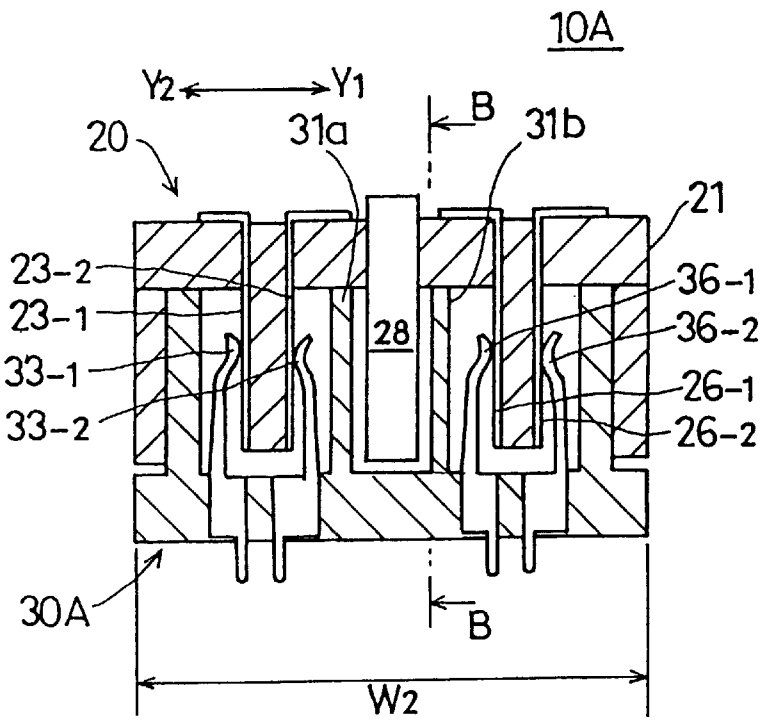
FIG. 5A is a cross-sectional diagram showing a connector assembly shown in FIG. 4.

FIG. 5A is a cross-sectional diagram showing a connector assembly shown in FIG. 4 and FIG. 5B is a cross-sectional diagram of the connector assembly taken along a line B—B shown in FIG. 5A.

When the plug connector 20 and the jack connector 30A are connected, the jack-type ground contact elements 48, 49 are in contact with the plug ground plate 28 at both end surfaces 28*b*. Therefore, the jack-type ground contact elements 48, 49 are provided within the thickness of the plug ground plate 28. Therefore, the width W2 of the connector assembly 10A is smaller than the width W1 of the above-described connector assembly 10. As a result, a mounting area of the connector assembly 10A is smaller than that of the connector assembly 10.

Figure 6:
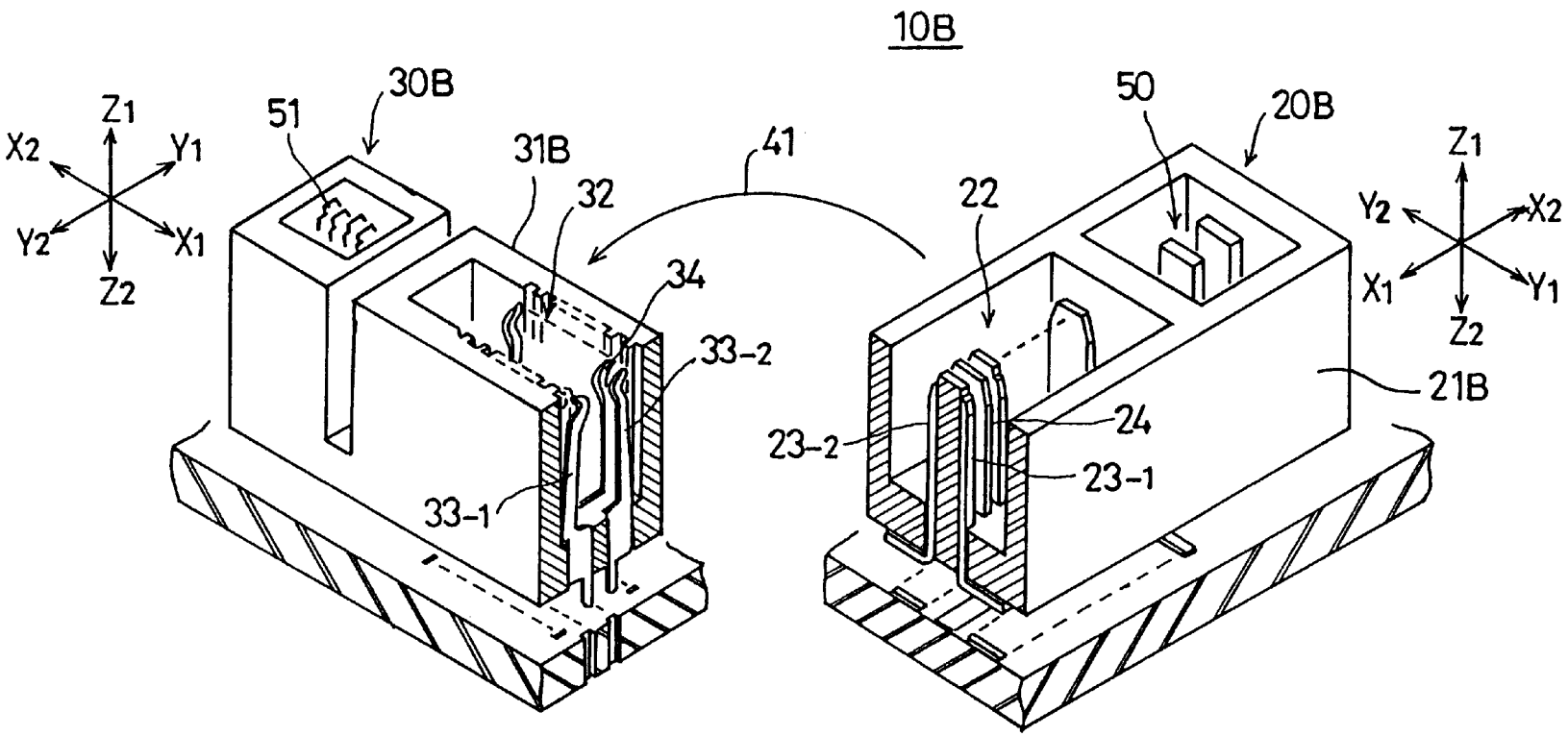
FIG. 6 is a perspective diagram showing a connector assembly of a third embodiment of the present invention.

FIG. 6 is a perspective diagram showing a connector assembly 10B of a third embodiment of the present invention. In FIG. 6, elements corresponding to the elements shown in FIGS. 1, 2A and 2B are indicated by the same reference numerals.

The connector assembly 10B includes a plug connector 20B for balanced transmission and a jack connector 30B for balanced transmission.

The plug connector 20B includes a plug-type electrically insulating body 21B (hereinafter referred to as a plug insulator 21B) supporting plug-type power supply contact elements 50 and the plug contact array 22. The plug-type power supply contact elements 50 are provided at the X2 end of the plug contact array 22.

The jack connector 30B has a structure corresponding to the above-described plug connector 20B. The jack connector 30B includes a jack-type electrically insulating body 31B (hereinafter referred to as a jack insulator 31B) supporting jack-type power supply contact elements 51 and the jack contact array 32.

When the plug connector 20B is connected to the jack connector 30B as shown by an arrow 41, the plug contact array 22 and the jack contact array 32 are connected. Also, the plug-type power supply contact elements 50 and the jack-type power supply contact elements 51 are connected. Therefore, with the above-described connector assembly 10B, there is no need for a power supply plug to be connected to a power supply jack.

Figure 7A:
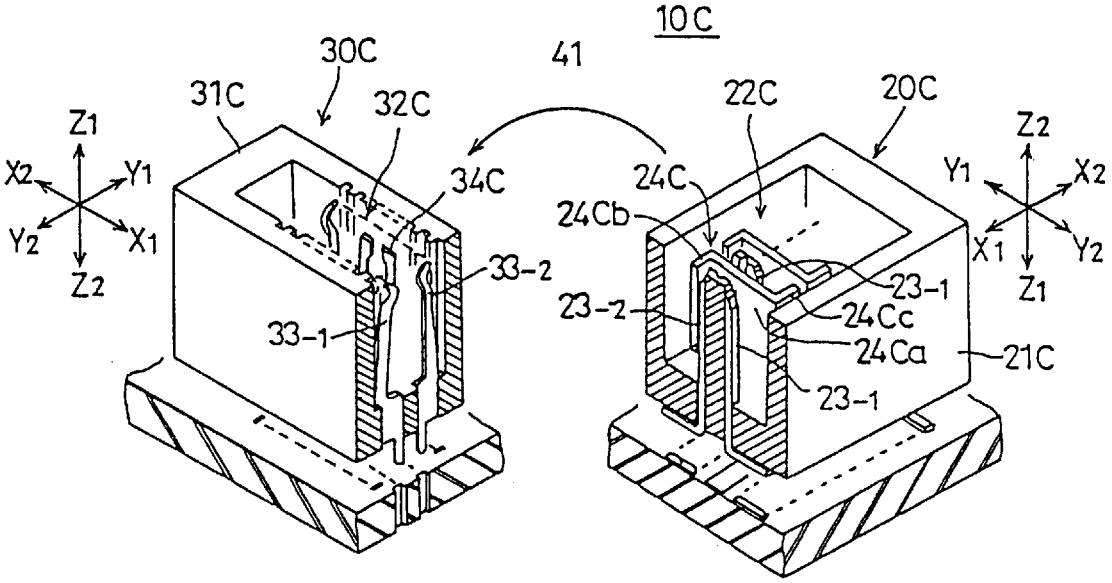
FIG. 7A is a perspective diagram showing a connector assembly of a fourth embodiment of the present invention.
Figure 7B:
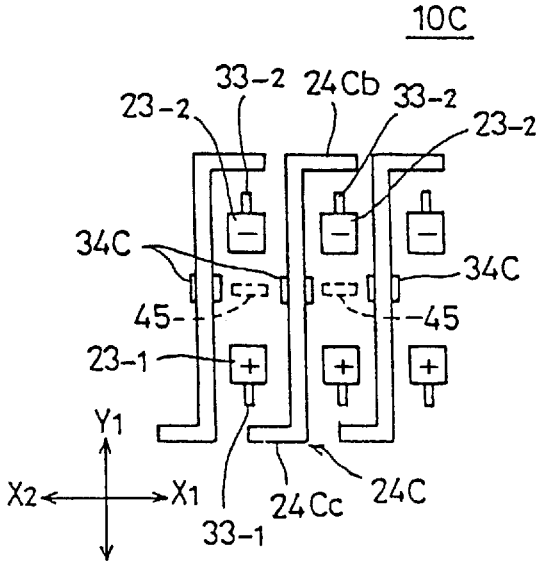
FIG. 7B is a schematic diagram showing a basic structure of the connector assembly shown in FIG. 7A.

FIG. 7A is a perspective diagram showing a connector assembly 10C of a fourth embodiment of the present invention. FIG. 7B is a schematic diagram showing a basic structure of the connector assembly shown in FIG. 7A. In FIGS. 7A and 7B, elements corresponding to the elements shown in FIGS. 1, 2A and 2B are indicated by the same reference numerals.

The connector assembly 10C includes a plug connector 20C for balanced transmission and a jack connector 30C for balanced transmission.

The plug connector 20C includes a plug-type electrically insulating body 21C (hereinafter referred to as a plug insulator 21C) supporting a plug contact array 22C. The plug contact array 22C includes the plurality of pairs of plug-type signal contact elements 23-1, 23-2 (hereinafter referred to as plug signal contacts 23-1, 23-2) and a plurality of plug-type ground contact elements 24C alternately arranged in the X1–X2 directions. Each of the plug-type ground contact elements 24C (hereinafter referred to as plug ground contacts 24C) is substantially Z-shaped when viewed vertically downwards in the Z1 direction. Again viewing vertically downwards in the Z1 direction, the plug ground contacts 24C include a main plate part 24C*a*, a wing part 24Cb extending in the X1 direction from the Y1 end of the main plate part 24Ca and a wing part 24Cc extending in the X2 direction from the Y2 end of the main plate part 24Ca. The wing part 24Cb covers the Y1 side of the plug signal contact 23-2 adjacent to the plug ground contact 24C in the X1 direction. The wing part 24Cc covers the Y2 side of the plug signal contact 23-1 adjacent to the plug ground contact 24C in the X2 direction.

The jack connector 30C for balanced transmission has a structure corresponding to the above-described plug connector 20C for balanced transmission. The jack connector 30C includes a jack-type electrically insulating body 31C (hereinafter referred to as a jack insulator 31C). The jack insulator 31C holds a jack-type contact element array 32C (hereinafter referred to as a jack contact array 32C). The jack contact array 32C includes, in the jack connector 30C, the plurality of pairs of jack-type signal contact elements 33-1, 33-2 and a plurality of jack-type ground contact elements 34C alternately arranged in the X1–X2 directions. The jack-type ground contact elements 34C will be hereinafter referred to as jack ground contacts 34C and the jack-type signal contact elements 33-1, 33-2 will be hereinafter referred to as jack signal contacts 33-1, 33-2. The jack ground contacts 34C are provided such that the main plate part 24Ca of the ground contact 24C is held between the jack ground contacts 34C.

FIG. 7B is a schematic diagram showing a basic structure of the connector assembly 10C shown in FIG. 7A, where the plug connector 20C and the jack connector 30C are connected. The plug signal contacts 23-1 and the jack signal contacts 33-1 are in contact. Also, the plug signal contacts 23-2 and the jack signal contacts 33-2 are in contact. Further, the plug ground contact 24C is connected to the jack ground contact 34C such that the main plate part 24Ca of the plug ground contact 24C is held between the jack ground contact 34C. The wing parts 24Cb are aligned in the X1–X2 directions and cover the Y1 sides of the plug signal contacts 23-2 and the jack signal contacts 33-2. Also, the wing parts 24Cc are aligned in the X1–X2 directions and cover the Y2 sides of the plug signal contacts 23-1 and the jack signal contacts 33-1.

Therefore, the signal contacts 23-1, 23-2, 33-1, 33-2 are protected from external electromagnetic noise by the wing parts 24Cb and 24Cc. Thus, there is no need for a shielding plate (see FIG. 10) provided outside the plug connector and the jack connector.

Also, as has been described with the above embodiments, the virtual ground planes 45 are created between the plug signal contacts 23-1 and 23-2.

Figure 8A:
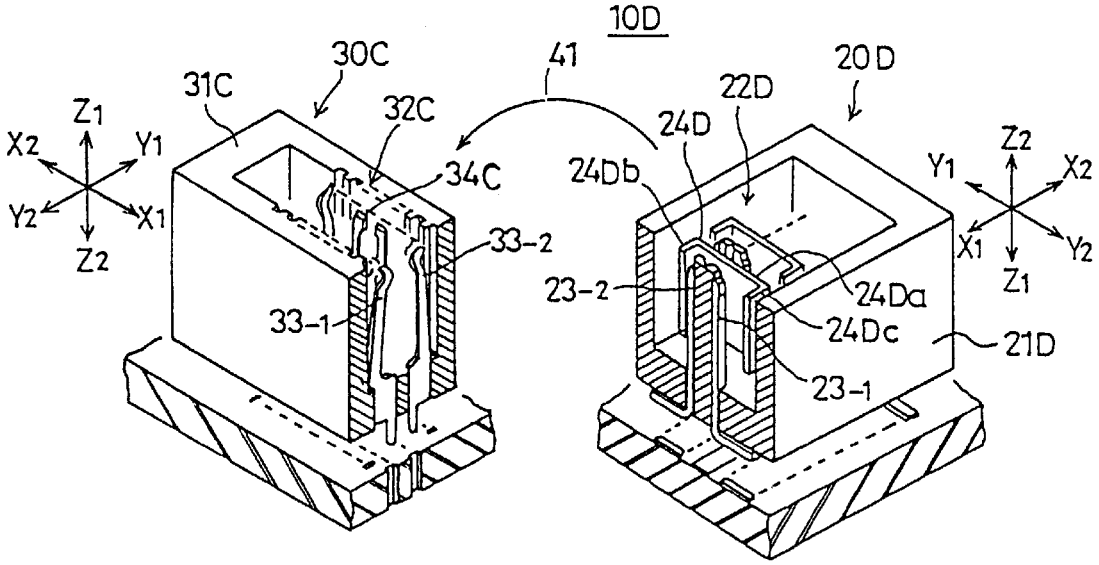
FIG. 8A is a perspective diagram showing a connector assembly of a fifth embodiment of the present invention.
Figure 8B:
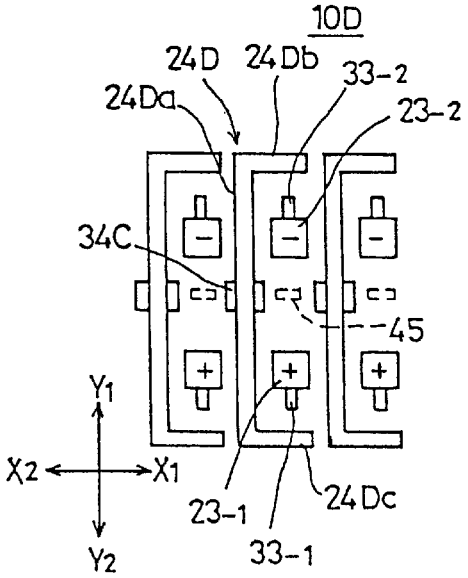
FIG. 8B is a schematic diagram showing a basic structure of the connector assembly shown in FIG. 8A.

FIG. 8A is a perspective diagram showing a connector assembly 10D of a fifth embodiment of the present invention. FIG. 8B is a schematic diagram showing a basic structure of the connector assembly shown in FIG. 8A. In FIGS. 8A and 8B, elements corresponding to the elements shown in FIGS. 1, 2A and 2B are indicated by the same reference numerals.

The connector assembly 10D is different from the connector assembly 10C shown in FIGS. 7A and 7B in that it includes a plug connector 20D for balanced transmission. The connector assembly 10D includes the jack connector 30C for balanced transmission, which jack connector 30C is used for the connector assembly 10C.

The plug connector 20D includes a plug-type electrically insulating body 21D (hereinafter referred to as a plug insulator 21D) supporting a plug contact array 22D. The plug contact array 22D includes the plurality of pairs of plug-type signal contact elements 23-1, 23-2 (hereinafter referred to as plug signal contacts 23-1, 23-2) and a plurality of plug-type ground contact elements 24D alternately arranged in the X1–X2 directions. The plug contact array 22D differs from the plug contact array 22C in that it is provided with the plug-type ground contacts 24D (hereinafter referred to as plug ground contacts 2DC) instead of the plug-type ground contact elements 24C. Viewing vertically downwards in the Z1 direction, the plug ground contacts 24D include a main plate part 24Da, a wing part 24Db extending in the X1 direction from the Y1 end of the main plate part 24Da and a wing part 24Dc extending in the X1 direction from the Y2 end of the main plate part 24Da. The wing part 24Db covers the Y1 side of the plug signal contact 23-2 adjacent to the plug ground contact 24D in the X1 direction. The wing part 24Dc covers the Y2 side of the plug signal contact 23-1 adjacent to the plug ground contact 24D in the X1 direction.

FIG. 8B is a schematic diagram showing a basic structure of the connector assembly 10D shown in FIG. 8A, where the plug connector 20D and the jack connector 30C are connected. The plug signal contacts 23-1 and the jack signal contacts 33-1 are in contact. Also, the plug signal contacts 23-2 and the jack signal contacts 33-2 are in contact. Further, the plug ground contact 24D is connected to the jack ground contact 34C such that the main plate part 24Da of the plug ground contact 24D is held between the jack ground contact 34C. The wing parts 24Db are aligned in the X1–X2 directions and cover the Y1 sides of the plug signal contacts 23-2 and the jack signal contacts 33-2. Also, the wing parts 24Dc are aligned in the X1–X2 directions and cover the Y2 sides of the plug signal contacts 23-1 and the jack signal contacts 33-1.

Therefore, the signal contacts 23-1, 23-2, 33-1, 33-2 are protected from external electromagnetic noise by the wing parts 24Db and 24Dc. Thus, there is no need for a shielding plate (see FIG. 10) provided outside the plug connector and the jack connector.

Also, as has been described with the above embodiments, the virtual ground planes 45 are created between the plug signal contacts 23-1 and 23-2.

Figure 9A:
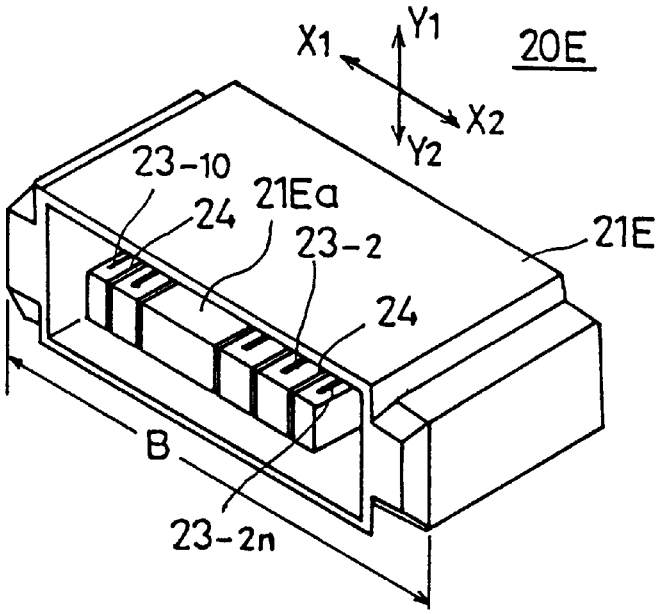
FIG. 9A is a perspective diagram showing a connector assembly of a sixth embodiment of the present invention.
Figure 9B:
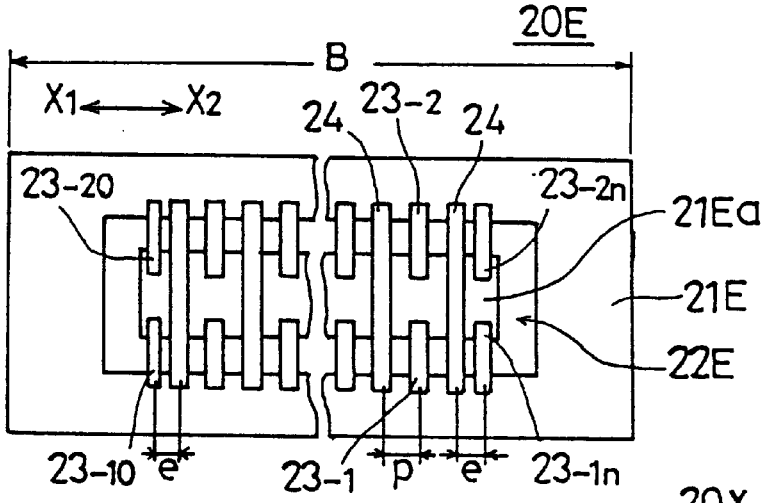
FIG. 9B is a cross-sectional diagram showing the connector assembly shown in FIG. 9A.

FIG. 9A is a perspective diagram showing a connector assembly of a sixth embodiment of the present invention and FIG. 9B is a cross-sectional diagram showing the connector assembly shown in FIG. 9A.

With the connector assembly for balanced transmission including a plug connector and a jack connector, it is required that the impedance be matched for all pairs of signal contact elements. Also, it is preferred that the connector assembly have a reduced size in the longitudinal direction so as to have a compact shape. Particularly, the compact shape is desired when a greater number of signals are provided.

Figure 9C:
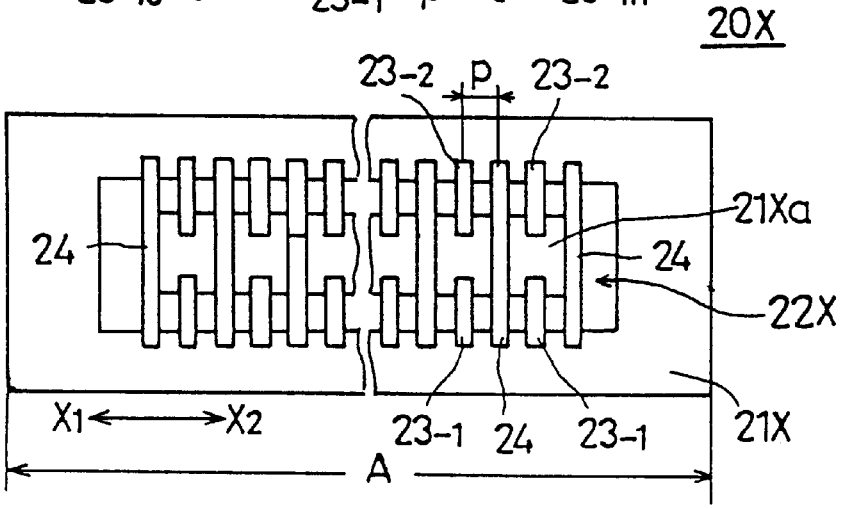
FIG. 9C is a cross-sectional diagram showing the connector assembly of a known structure.

Generally, as shown in FIG. 9C, the plug connector 20X includes a plug-type electrically insulating body 21X (hereinafter referred to as a plug insulator 21X, supporting a plug-type contact element array 22X. The plug contact array 22X has a structure such that the plurality of pairs of plug-type signal contact elements 23-1, 23-2 and the plurality of plate-like plug-type ground contact elements 24 are alternately arranged on an elongated raised part 21Xa provided at the center of the plug insulator 21X in the X1–X2 directions with a pitch p. The pitch p has a predetermined value. Also, impedance is matched for all pairs of signal contact elements. The ground contacts 24 are provided on the X1 end and the X2 end. The size of the plug connector 20X in the X1–X2 direction is A.

It is an object of the sixth embodiment to reduce the size A.

The plug connector 20E shown in FIGS. 9A and 9B includes a plug-type electrically insulating body 21E (hereinafter referred to as a plug insulator 21E) supporting a plug-type contact element array 22E. The plug contact array 22E has a structure such that the plurality of pairs of plug-type signal contact elements 23-1, 23-2 and the plurality of plate-like plug-type ground contact elements 24 are alternately arranged on an elongated raised part 21Ea provided at the center of the plug insulator 21E in the X1–X2 directions with the pitch p. Plug-type signal contact elements 23-1$_0$ and 23-2$_0$ are provided at the X1 end and plug-type signal contact elements 23-1$_n$ and 23-2$_n$ are provided at the X2 end. The distance between the plug-type signal contact elements 23-1$_0$ and 23-2$_0$ at the X1 end and an adjacent ground contact 24 has a length e. The distance between the plug-type signal contact elements 23-1$_n$ and 23-2$_n$ at the X2 end and an adjacent ground contact 24 also has a length e. It is to be noted that the length e is half the pitch p so than the length e is shorter that the pitch p. Therefore, the impedance of the plug-type signal contact elements 23-1$_0$, 23-2$_0$, 23-1$_n$, 23-2$_n$ is equal to that of other plug signal contacts 23-1, 23-2.

As shown in FIG. 9B, the size of the plug connector 20E in the X1–X2 direction is B, which is smaller than the size A of the plug connector shown in FIG. 9C. This is achieved by the fact that there are no ground contacts 24 provided at either end and that the distance e is smaller that the pitch p. Therefore, the plug connector 20E is reduced in its size compared to the known plug connector 20X.

Figure 10:
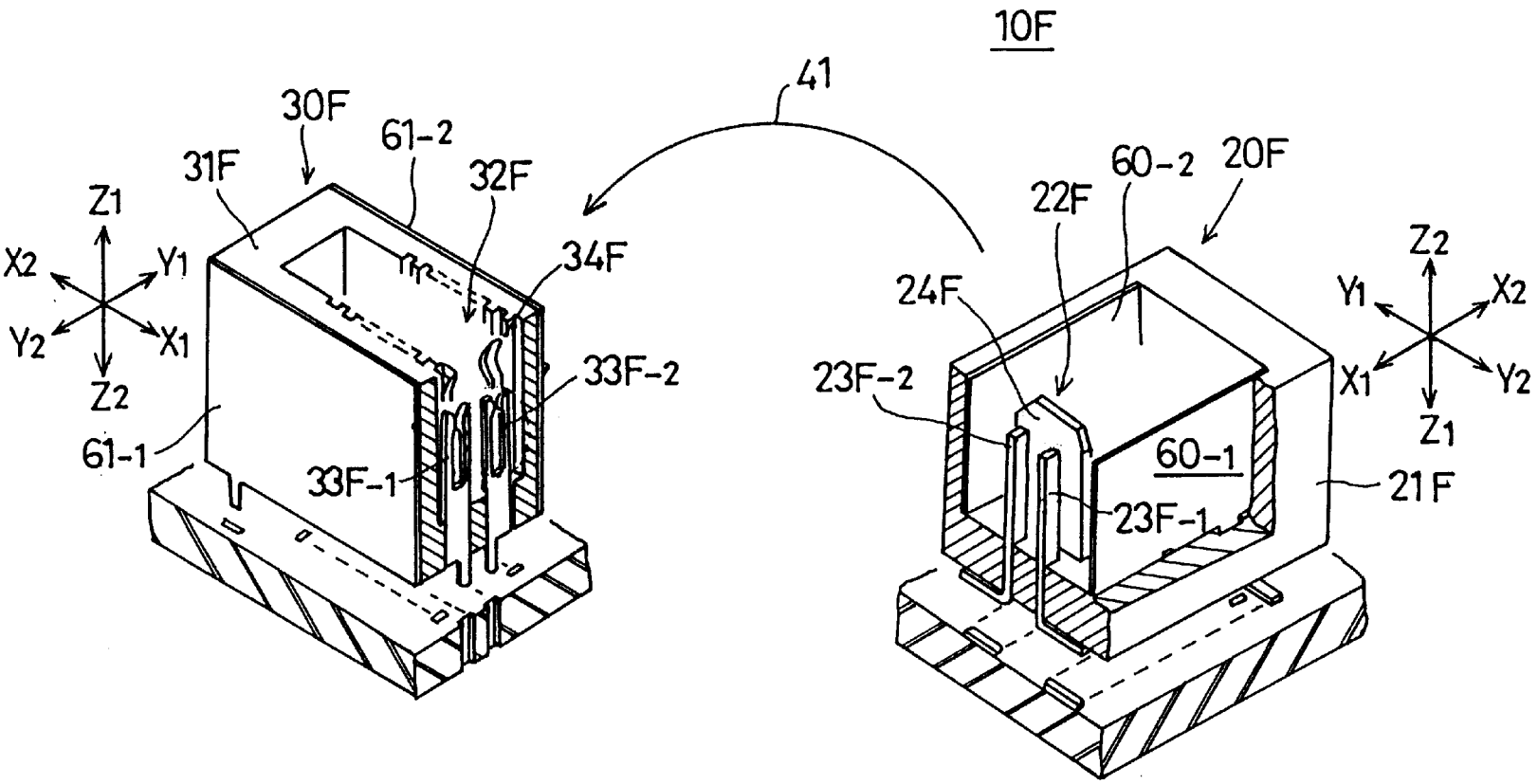
FIG. 10 is a perspective diagram showing a connector assembly of a seventh embodiment of the present invention.

FIG. 10 is a perspective diagram showing a connector assembly of a seventh embodiment of the present invention.

With the connector assembly for balanced transmission including a plug connector and a jack connector, it is desirable that there be a stable connection between the plug-type signal contact elements and the jack-type signal contact elements. A plug connector 20F of the present invention is provided in order to achieve the above need.

The connector assembly 10F includes a plug connector 20F for balanced transmission and a jack connector 30F for balanced transmission.

The plug connector 20F includes a plug-type electrically insulating body 21F (hereinafter referred to as a plug insulator 21F) supporting a plug contact array 22F and plug-type shielding plates 60-1, 60-2. The plug-type shielding plates 60-1, 60-2 are provided on inner surfaces of the plug insulator 21F in the Y1, Y2 directions. The plug contact array 22F includes a plurality of pairs of plug-type signal contact elements 23F-1, 23F-2 (hereinafter referred to as plug signal contacts 23F-1, 23F-2) and a plurality of plug-type ground contact elements 24F alternately arranged in the X1–X2 directions. Each of the plug signal contacts 23F-1, 23F-2 has a knife-shape.

The jack connector 30F has a structure corresponding to the above-described plug connector 20F. The jack connector 30F includes a jack-type electrically insulating body 31F (hereinafter referred to as a jack insulator 31F) supporting a jack contact array 32F and jack-type shielding plates 61-1, 61-2. The jack-type shielding plates 61-1, 61-2 are provided on inner surfaces of the jack insulator 31F in the Y1, Y2 directions. The jack contact array 32F includes a plurality of pairs of jack-type signal contact elements 33F-1, 33F-2 (hereinafter referred to as jack signal contacts 33F-1, 33F-2) and a plurality of jack-type ground contact elements 34F alternately arranged in the X1–X2 directions. Each of the jack signal contacts 33F-1, 33F-2 has a fork-shape and is arranged so as to hold the plug signal contacts 23F-1, 23F-2.

When the plug connector 20F is connected to the jack connector 30F as shown by an arrow 41, the plug signal contacts 23F-1, 23F-2 are held between the jack signal contacts 33F-1, 33F-2. In this state, the plug signal contact 23F-1 and the jack signal contact 33F-1 are electrically connected via two contact points. Similarly, the plug signal contact 23F-2 and the jack signal contact 33F-2 are electrically connected via two contact points. Therefore, an electrical connection between the plug signal contacts 23F-1, 23F-2 and the jack signal contacts 33F-1, 33F-2 is more stable than a connection via one contact point.

Also, the plug ground contact 24F is electrically connected to the jack ground contact 34F. Further, the plug-type shielding plates 60-1, 60-2 and the jack-type shielding plates 61-1, 61-2, respectively, are electrically connected.

Figure 11:
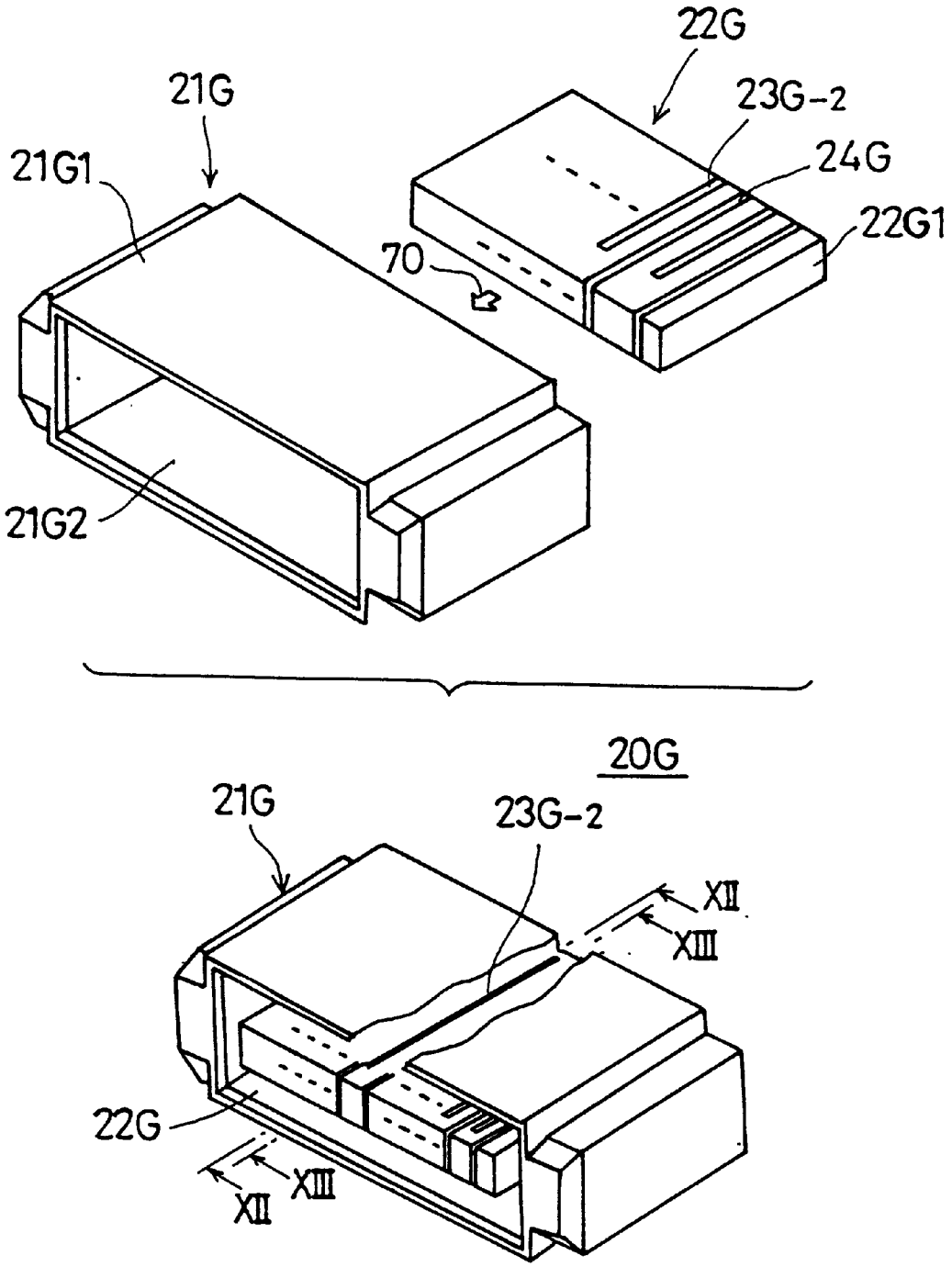
FIG. 11 is a perspective diagram showing a plug connector of an eighth embodiment of the present invention.

FIG. 11 is a perspective diagram showing a plug connector 20G of an eighth embodiment of the present invention.

The plug connector 20G is constructed using a MID (Molded Interconnection Device), and includes a plug-type electrically insulating body 21G (hereinafter referred to as a plug insulator 21G) and plug-type contact element array component 22G. The plug insulator 21G is a substantially box-shaped component formed by resin molding. The plug-type contact element array component 22G is a separate component also formed by resin molding. The plug-type contact element array component 22G is fixed to the plug insulator 21G by pressing the plug-type contact element array component 22G into the plug insulator 21G from the bottom side (backside) as shown by an arrow 70.

Figure 12:
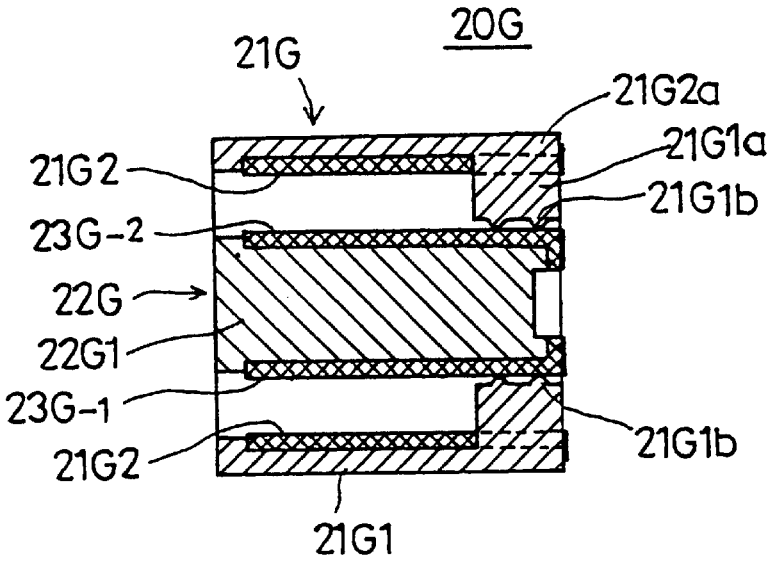
FIG. 12 is a cross-sectional diagram of the connector assembly of FIG. 11 taken along a line XII—XII shown in FIG. 11.
Figure 13:
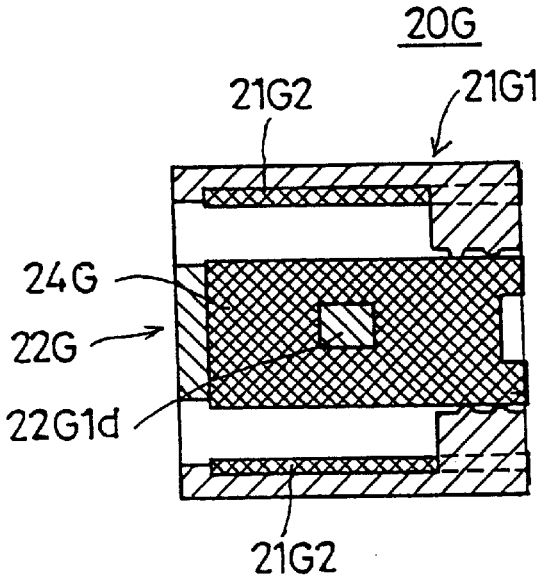
FIG. 13 is a cross-sectional diagram of the connector assembly of FIG. 11 taken along a line XIII—XIII shown in FIG. 11.
Figure 14:
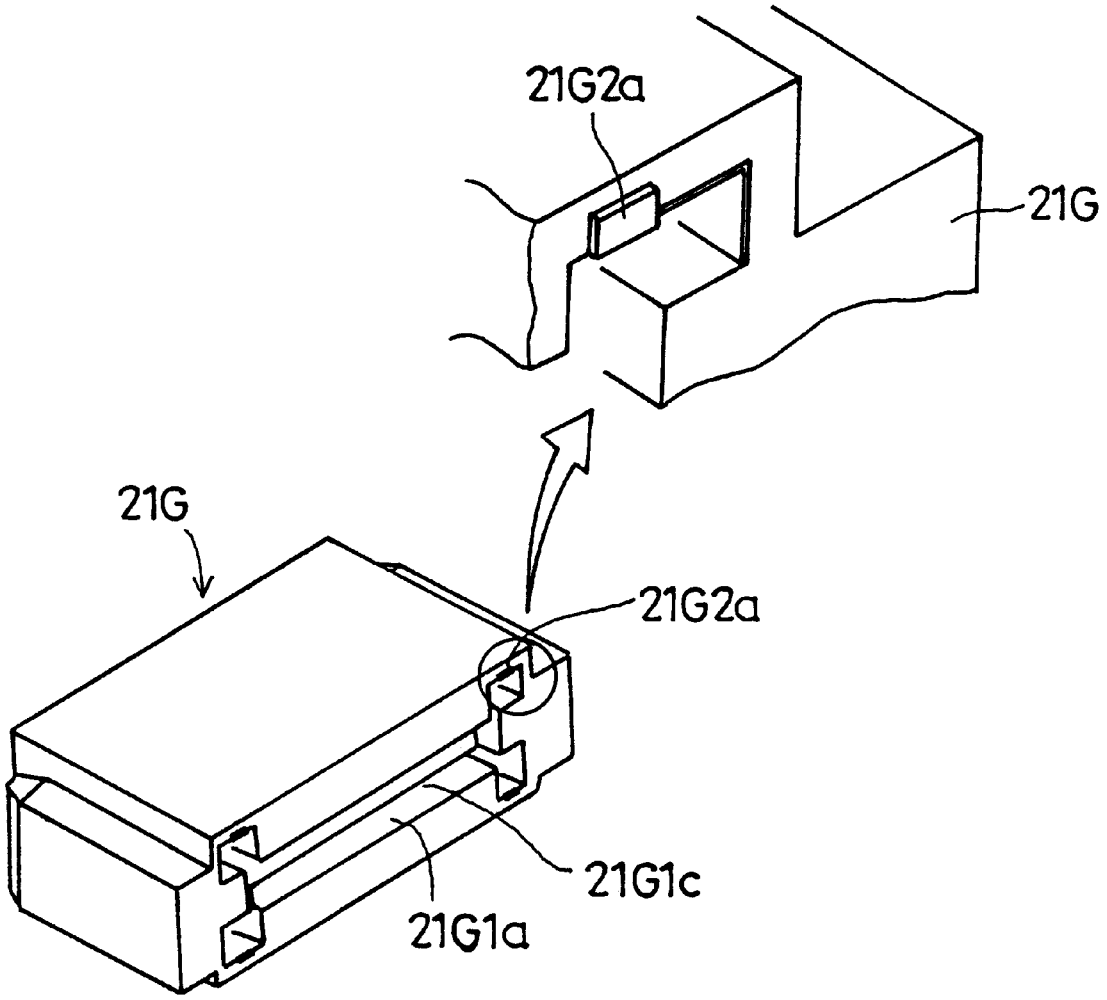
FIG. 14 is a perspective diagram showing a connector assembly shown in FIG. 11 from the backside.

Referring to FIGS. 11 to 14, the plug insulator 21G includes a plug insulator main part 21G1 and a shield surrounding part 21G2. The plug insulator main part 21G1 is made of an electrically insulating resin and has a box-like shape. The shield surrounding part 21G2 made of conductive resin covers the inner periphery of the plug insulator main part 21G1. The plug insulator main part 21G1 has ribs 21G1*a* at the bottom part and substantially surrounding the periphery. An opening 21G1*c* is provided inside the ribs 21G1*a*. As shown in FIG. 14, terminal parts 21G2*a* are provided so as to be extending at four corners of the bottom surface of the plug insulator main part 21G1 from the ends of the shield surrounding part 21G2. As shown in FIGS. 12 and 13, small protrusions 21G1*b* are provided on an inner surface of the rib 21G1*a*, so as to facilitate an insertion of the plug-type contact element array component 22G.

The plug insulator 21G may be manufactured by first forming the shield surrounding part 21G2 using a conductive resin, and then forming the plug insulator main part 21G1 around the shield surrounding part 21G2 using an electrically insulating resin. Alternatively, the plug insulator main part 21G1 may be formed first, and the shield surrounding part 21G2 may be formed afterwards inside the plug insulator main part 21G1.

Figure 15:
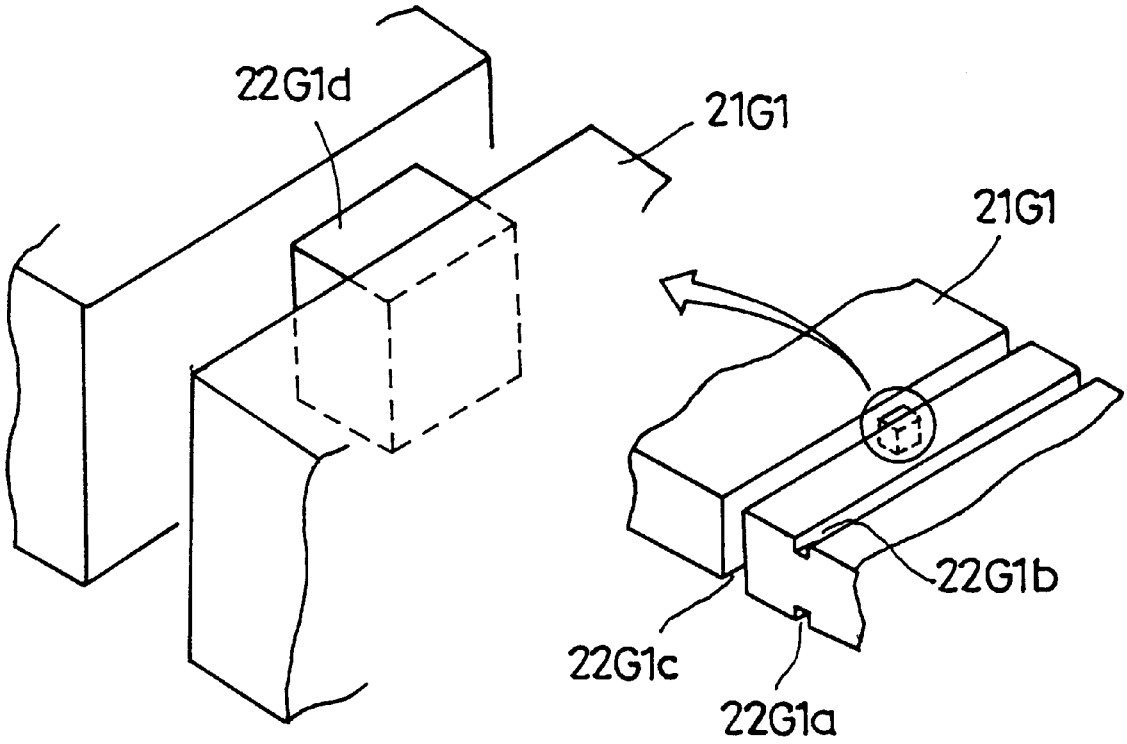
FIG. 15 is a perspective enlarged view of the plug insulator main part shown in FIG. 11.

Referring to FIGS. 11 to 14, the plug-type contact element array component 22G includes the plug insulator main part 21G1 shown in FIG. 15, a plurality of pairs of plug-type signal contact elements 23G-1, 23G-2 and a plurality of plug-type ground contact elements 24G. The plug-type signal contact elements 23G-1, 23G-2 and the plurality of plug-type ground contact elements 24G are alternately arranged in the X1–X2 directions. Each of the plug-type ground contact elements 24G (hereinafter referred to as plug ground contacts 24G) is made of electrically insulating resin and has a substantially plate-like shape. Also, the signal contact elements 23G-1, 23G-2 are hereinafter referred to as plug signal contacts 23G-1, 23G-2.

A plate-like plug insulator main part 22G1 is provided with a plurality of grooves 22G1*a*, 22G1*b* forming signal contact parts and a plurality of grooves 22G1*c* forming ground contact parts. As shown in an enlarged view of FIG. 15, the plug insulator main part 21G1 is connected by joining parts 22G1*d* provided at the grooves 22G1*c*. The joining parts 22G1*d* are substantially cubic.

The plug signal contacts 23G-1, 23G-2 are made of conductive resin. As shown in FIG. 12, the plug signal contacts 23G-1, 23G-2 are provided so as to fill the grooves 22G1*a*, 22G1*b*. The plug ground contacts 24G are made of conductive resin. As shown in FIG. 13, the plug ground contacts 24G are provided so as to fill the grooves 22G1*c* and around the joining parts 22G1*d*.

The plug-type contact element array components 22G are manufactured by first forming the plug insulator main part 22G1 using electrically insulating resin and then forming the plug signal contacts 23G-1, 23G-2 and the plug ground contacts 24G using conductive resin.

In the prior art, the plug connector had a structure such that the shield surrounding part 21G2 is formed by a shielding plate, the plug signal contacts 23G-1, 21G-2 are formed by signal contact members, and the plug ground contacts 24G are formed by ground contact members. The plug connector 20G is constructed using fewer components and is reduced in its weight and cost compared to the above-described plug connector of the prior art.

Figure 16A:
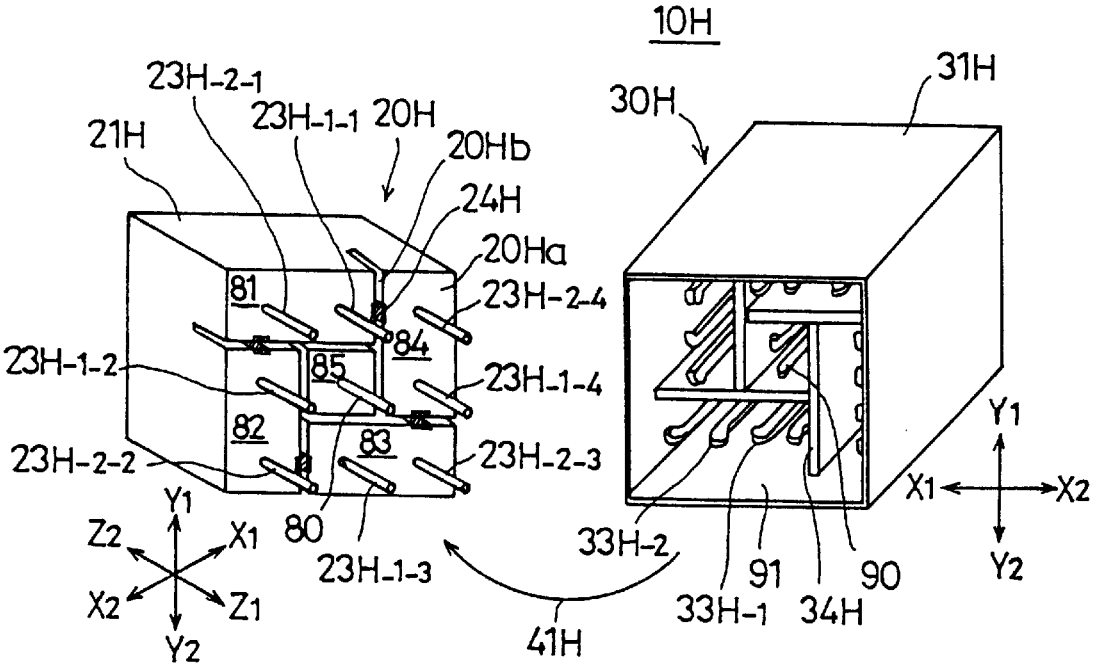
FIG. 16A is a perspective diagram showing a connector assembly of a ninth embodiment of the present invention.
Figure 16B:
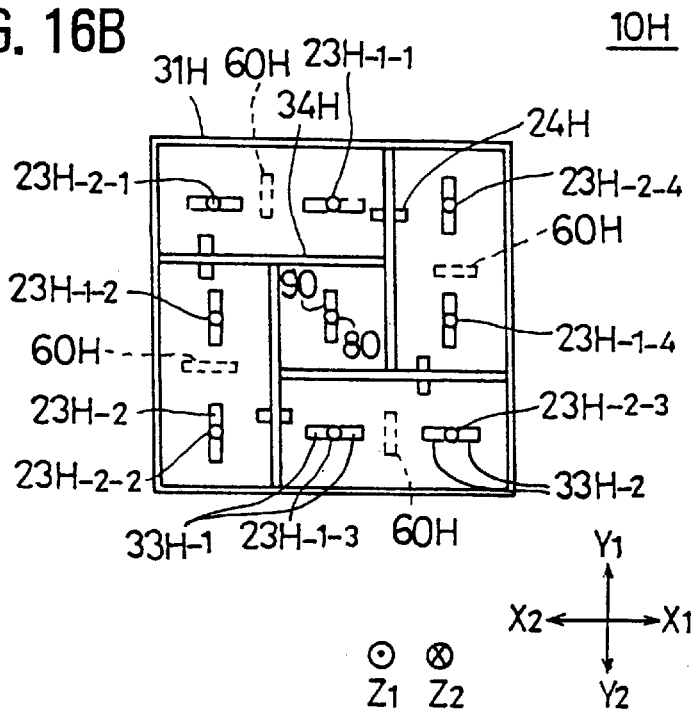
FIG. 16B is a schematic diagram showing a basic structure of the connector assembly shown in FIG. 16A.

FIG. 16A is a perspective diagram showing a connector assembly 10H of a ninth embodiment of the present invention. FIG. 16B is a schematic diagram showing a basic structure of the connector assembly 10H shown in FIG. 16A.

A connector assembly for balanced transmission including a plug connector and a jack connector generally has an elongated shape in a lateral direction. Therefore, it is difficult to mount such connector assembly on, for example, a printed-circuit board when there is not enough space. The connector assembly 10H of the present embodiment and a plug connector of the next embodiment is provided so as to solve this problem.

As shown in FIG. 16A, the connector assembly 10H includes a plug connector 20H for balanced transmission and a jack connector 30H for balanced transmission.

The plug connector 20H includes a plug-type electrically insulating body 21H (hereinafter referred to as a plug insulator 21H), four pairs of plug-type contact elements 23H-1-1, 23H-2-1 to 23H-1-4, 23H-2-4 (hereinafter referred to as plug contacts 23H-1-1, 23H-2-1 to 23H-1-4, 23H-2-4) and four plug-type ground contact elements 24H. The plug insulator 21H is substantially cubic. Four grooves 21Hb are provided on a front surface 21Ha of the plug insulator 21H such that the grooves 21Hb are arranged in a shape of two T's joined together with one of the T's being inverted. Thus, the front surface 21Ha of the plug insulator 21H is divided into five islands 81 to 85. Each of the four islands 81 to 84 formed along the periphery of the plug insulator 21H is provided with the pair of plug signal contacts 23H-1-1, 23H-2-1 to 23H-1-4, 23H-2-4, respectively. The plurality of pairs of plug signal contacts 23H-1-1, 23H-2-1 to 23H-1-4, 23H-2-4 are provided so as to project from the surface 21Ha of the plug insulator 21H in the Z1 direction. The four pairs of plug signal contacts 23H-1-1, 23H-2-1 to 23H-1-4, 23H-2-4 are provided in a fylfot arrangement when viewed in the Z2-direction. The central island 85 is provided with a plug-type central signal contact element 80 projecting in the Z1-direction. The plug ground contact 24H is provided at each of the grooves 21Hb.

The jack connector 30H for balanced transmission has a structure corresponding to the above-described plug connector 20H for balanced transmission. The jack connector 30H includes a jack-type electrically insulating body 31H (hereinafter referred to as a jack insulator 31H). The jack insulator 31H holds four pairs of jack-type signal contact element 33H-1, 33H-2 (hereinafter referred to as jack signal contacts 33H-1, 33H-2), four plate-like jack-type ground contact elements 34H (hereinafter referred to as a jack ground contact 34H), a fork-like jack-type signal contact element 90 and a surrounding shield plate 91. The surrounding shield plate 91 is provided on an inner surface of the jack insulator 31H. The four jack ground contacts 34H are provided so as to correspond to the above-described grooves 21Hb. The four pairs of jack-type signal contact element 33H-1, 33H-2 are arranged so as to correspond to the above-described four pairs of plug signal contacts 23H-1-1, 23H-2-1 to 23H-1-4, 23H-2-4. The jack-type signal contact element 90 is provided at the center so as to correspond to the above-described plug-type signal contact element 80.

When the plug connector 20H is connected to the jack connector 30H as shown by an arrow 41H, the connector assembly 10H has a structure as shown in FIG. 16B. The plug insulator 21H is fitted into the jack insulator 31H. Also, the jack ground contacts 34H are inserted into the grooves 20Hb. The plug signal contacts 23H-1-1, 23H-2-1 to 23H-1-4, 23H-2-4 are connected to corresponding jack signal contacts 33H-1, 33H-2, the plug ground contacts 24G are connected to jack ground contacts 34H, and the plug-type central signal contact element 80 is connected to the jack-type central signal contact element 90.

The above-described connector assembly 10H may be accommodated in a substantially cubic space.

The neighboring plug signal contacts 23H-1-1, 23H-2-1 to 23H-1-4, 23H-2-4 and jack signal contacts 33H-1, 33H-2 connected thereto are separated by the jack ground contacts 34H.

When balanced transmission signals are transmitted, a virtual ground plane 60H is created between each pair of plug signal contacts 23H-1-1, 23H-2-1 to 23H-1-4, 23H-2-4.

The plug-type central signal contact 80 and the jack-type central signal contact 90 connected to each other are surrounded by the jack ground contacts 34H.

Figure 17:
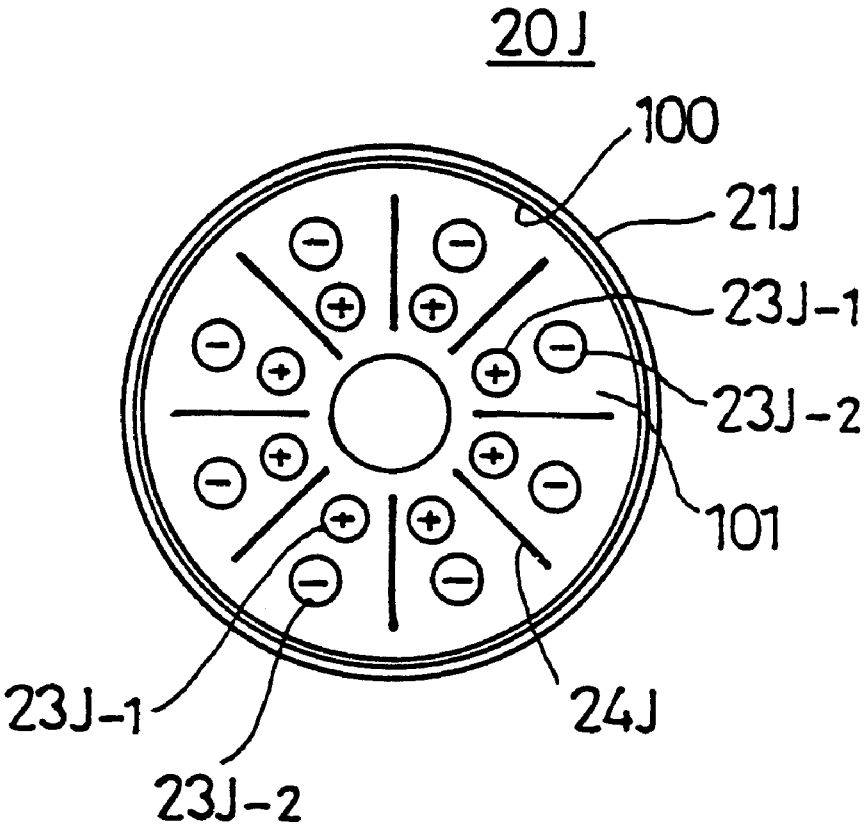
FIG. 17 is a cross-sectional diagram showing a plug connector of a tenth embodiment of the present invention.

FIG. 17 is a cross-sectional diagram showing a plug connector 20J of a tenth embodiment of the present invention.

The plug connector 20J includes a plug-type electrically insulating body 21J (hereinafter referred to as a plug insulator 21J) having a cylindrical shape, eight pairs of plug-type contact elements 23J-1, 23J-2 (hereinafter referred to as plug contacts 23J-1, 233-2) and eight plug-type ground contact elements 24J. The plug insulator 21J includes a circular insertion opening and a cylindrical shielding member 100 provided on its inner surface. The eight plug ground contacts 24J are provided with equal angular intervals and extend radially. Also, eight substantially fan-shaped chambers 101 are formed between neighboring plug ground contacts 24J. A pair of plug contacts 23J-1, 23J-2 is provided in the respective chambers 101 so as to be aligned in the radial direction. The neighboring pairs of plug signal contacts 23J-1, 23J-2 are separated and shielded by the plug ground contact 24J provided between the neighboring pairs.

The above-described plug connector 20J may be accommodated in a cylindrical space.

The plug connector 20J is connected to a jack connector (not shown in the Figures) having a corresponding structure.

Figure 18:
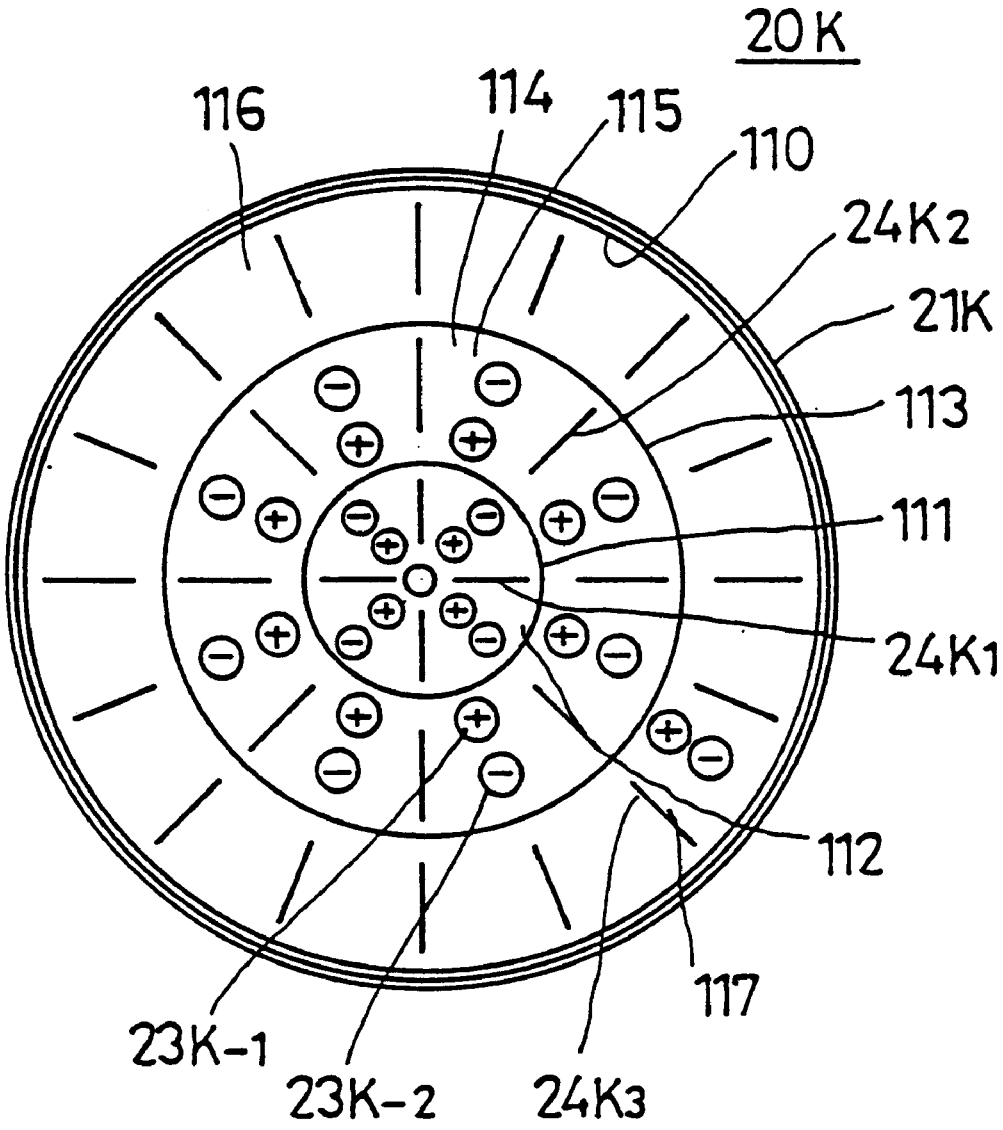
FIG. 18 is a cross-sectional diagram showing a plug connector of an eleventh embodiment of the present invention.

FIG. 18 is a cross-sectional diagram showing a plug connector 20K of an eleventh embodiment of the present invention. The plug connector 20K is a variant of the above-described plug connector 20J and is capable of accommodating further pairs of plug-type signal contact elements 23K-1, 23K-2.

The plug connector 20K includes a plug-type electrically insulating body 21K (hereinafter referred to as a plug insulator 21K) having a cylindrical shape. The plug insulator 21K includes a circular insertion opening and a cylindrical peripheral shielding member 110 provided on its inner surface.

The plug insulator 21K also includes a first shielding member 111 provided near the center, four plate-like first plug-type ground contact elements 24K1 (hereinafter referred to as first plug ground contacts 24K1) and four substantially fan-shaped first chambers 112. The four plug ground contacts 24K1 are provided at equal angular intervals and extend radially. A second shielding member 113 is provided at an outer position to the first shielding member 111. A first annular part 114 is formed between the cylindrical first shielding member 111 and the cylindrical second shielding member 113.

The first annular part 114 is provided with eight plate-like second plug-type ground contact elements 24K2 (hereinafter referred to as second plug ground contacts 24K2) and eight substantially fan-shaped second chambers 115. The second plug ground contacts 24K2 are provided at equal angular intervals and extend radially, and are arranged such that four of the second plug ground contacts 24K2 are aligned with the corresponding first plug ground contacts 24K1. Two substantially fan-shaped second chambers 115 are formed corresponding to each of the substantially fan-shaped first chambers 112. A second annular part 116 is formed between the cylindrical second shielding member 113 and the cylindrical peripheral shielding member 110.

The second annular part 116 is provided with sixteen plate-like third plug-type ground contact elements 24K3 (hereinafter referred to as third plug ground contacts 24K3) and sixteen substantially fan-shaped second chambers 117. The third plug ground contacts 24K3 are provided at equal angular intervals and extend radially, and are arranged such that eight of the third plug ground contacts 24K3 are aligned with the corresponding second plug ground contacts 24K2. Two substantially fan-shaped third chambers 117 are formed corresponding to each of the substantially fan-shaped second chambers 112.

Each of the above-described twenty-eight substantially fan-shaped chambers 112, 115, 117 is provided with a pair of plug signal contacts 23K-1, 23K-2 aligned in a radial direction. The neighboring pairs of plug signal contacts 23K-1, 23K-2 are separated and shielded by plug ground contacts 24K1, 24K2, 24K3 provided between the neighboring pairs. Also, the plug signal contacts 23K-1, 23K-2 at an inner position and the plug signal contacts 23K-1, 23K-2 at an outer position are separated and shielded by the cylindrical shielding members 111, 113.

The above-described plug connector 20K may be accommodated in a cylindrical space.

The plug connector 20K is connected to a jack connector (not shown in the Figures) having a corresponding structure.

Note that the above-described second to eleventh embodiments have a strip-line structure and virtual ground planes in a similar manner to the first embodiment.

Further, the present invention is not limited to these embodiments, but variations and modifications may be made without departing from the scope of the present invention.

The present application is based on Japanese priority application No. 10-237473 filed on Aug. 24, 1998, the entire contents of which are hereby incorporated by reference.

What is claimed is:

1. A plug connector for balanced transmission comprising:

a plurality of plug-type contact element arrays, each plug-type contact element array having a plurality of pairs of plug-type signal contact elements arranged parallel to each other in a row and a plurality of plug-type ground contact elements arranged alternately with said plurality of pairs of plug-type signal contact elements in said row;

a plug-type ground plate; and a plug-type insulating body made of an electrically insulating material for supporting said plurality of plug-type contact element arrays and said plug-type ground plate, wherein said plurality of plug-type contact element arrays extend parallel to each other and said plug-type ground plate is disposed between neighboring plug-type contact element arrays.

2. A jack connector for balanced transmission, comprising:

a plurality of jack-type contact element arrays, each jack-type contact element array having a plurality of pairs of jack-type signal contact elements arranged parallel to each other in a row and a plurality of first jack-type ground contact elements arranged alternately with said plurality of pairs of jack-type signal contact elements in said row;

a plurality of second jack-type ground contact elements to be engaged with a plug-type ground plate; and a jack-type insulating body made of an electrically insulating material for supporting said plurality of jack-type contact element arrays and said jack-type ground contact elements, wherein said plurality of jack-type contact element arrays extend parallel to each other and said second jack-type ground contact elements are disposed between neighboring jack-type contact element arrays.

3. A connector assembly for balanced transmission comprising:

a plug connector for balanced transmission; and a jack connector balanced transmission, said plug connector comprising:

a plurality of plug-type contact element arrays, each plug-type contact element array having a plurality of pairs of plug-type signal contact elements arranged parallel to each other in a row and a plurality of plug-type ground contact elements arranged alternately with said plurality of pairs of plug-type signal contact elements in said row;

a plug-type ground plate; and a plug-type insulating body made of an electrically insulating material for supporting said plurality of plug-type contact element arrays and said plug-type ground plate, said jack connector comprising:

a plurality of jack-type contact element arrays, each jack-type contact element array having a plurality of pairs of jack-type signal contact elements arranged parallel to each other in a row and a plurality of first jack-type ground contact elements arranged alternately with said plurality of pairs of jack-type signal contact elements in said row;

a plurality of second jack-type ground contact elements to be engaged with said plug-type ground plate; and a jack-type insulating body made of an electrically insulating materials for supporting said plurality of jack-type contact element arrays and said second jack-type ground contact elements, wherein said plurality of plug-type contact element arrays extend parallel to each other and said plug-type ground plate is disposed between neighboring plug-type contact element arrays, and said plurality of jack-type contact element arrays extend parallel to each other and said second jack-type ground contact elements are disposed between neighboring jack-type contact element arrays.

4. The connector assembly as claimed in claim 3, wherein said second jack-type ground contact elements are arranged parallel to each other and the plug-type ground plate is connected between said second jack-type ground contact elements.

5. The connector assembly as claimed in claim 3, wherein said second jack-type ground contact elements are arranged at both ends of the jack-type insulating body so as to be in contact with the plug-type ground plate at both end surfaces of the plug-type ground plate.

6.The connector assembly as claimed in claim 3, wherein terminal parts of said signal contact elements and said ground contact elements of said plug connector and/or said jack connector have a press-fit structure.

7. The plug connector as claimed in claim 1, wherein each pair of signal contact elements, when the respective voltages thereon and all transverse planes are equal in magnitude and opposite in polarity, establish a virtual ground plane therebetween, extending in the first direction.

8. The jack connector as claimed in claim 2, wherein each pair of signal contact elements, when the respective voltages thereon and all transverse planes are equal in magnitude and opposite in polarity, establish a virtual ground plane therebetween, extending in the first direction.

9. The plug connector as claimed in claim 1, wherein each plug-type ground plate is disposed symmetrically relatively to the respective pair of neighboring plug-type element arrays.

10. The jack connector as claimed in claim 2, wherein each plurality of second jack-type ground contact elements, disposed to engage a respective plug-type ground plate, is disposed symmetrically relatively to the respective pair of neighboring jack-type element arrays.

11. The plug connector as claimed in clam 1, wherein:

each plug-type ground contact element overlaps each pair of plug-type signal contact elements arranged adjacent to the plug-type ground contact element and comprises a shield reducing cross talk between the adjacent pair of plug-type contact elements.

12. The jack connector as claimed in claim 2, wherein:

each first jack-type ground contact element overlaps each pair of jack-type signal contact elements arranged adjacent to the first jack-type ground contact element and comprises a shield reducing cross talk between the adjacent pair of jack-type signal contact elements.

13. A plug connector for balanced transmission, comprising:

a plurality of plug-type contact element arrays, each plug-type contact element array having a plurality of pairs of plug-type signal contact elements arranged parallel to each other in a row extending in a first direction and the signal contact elements of each pair being spaced in a second direction perpendicular to the first direction and a plurality of plug-type ground contact elements arranged alternately with said plurality of pairs of plug-type signal contact elements in said row, said plurality of plug-type contact element arrays extending in the first direction and in parallel to each other;

a plug-type ground plate extending in the first direction and disposed in parallel between each pair of neighboring plug-type element arrays; and a plug-type insulating body made of an electrically insulating material for supporting said plurality of plug-type contact element arrays and said plug-type ground plate.

* * * * *